US010125522B2

(12) United States Patent
Ou et al.

(10) Patent No.: US 10,125,522 B2
(45) Date of Patent: Nov. 13, 2018

(54) METHOD FOR INSTALLING A LOCKSET

(71) Applicant: Hampton Products International Corporation, Foothill Ranch, CA (US)

(72) Inventors: Xin Ben Ou, Zhuhai (CN); Xin Min Ou, Zhuhai (CN); Han Gui Xiao, Zhuhai (CN); Zhi Man Yuan, Zhuhai (CN); Shi Hao Chen, Zhuhai (CN); Guo Hua Liu, Zhuhai (CN)

(73) Assignee: Hampton Products International Corporation, Foothill Ranch, CA (US)

( * ) Notice: Subject to any disclaimer, the term of this patent is extended or adjusted under 35 U.S.C. 154(b) by 70 days.

(21) Appl. No.: 15/239,055

(22) Filed: Aug. 17, 2016

(65) Prior Publication Data

US 2016/0356060 A1 Dec. 8, 2016

Related U.S. Application Data

(62) Division of application No. 14/027,916, filed on Sep. 16, 2013, now Pat. No. 9,447,610.

(51) Int. Cl.
*E05B 63/00* (2006.01)
*E05B 17/00* (2006.01)
(Continued)

(52) U.S. Cl.
CPC ..... *E05B 63/006* (2013.01); *E05B 1/0092* (2013.01); *E05B 17/0004* (2013.01);
(Continued)

(58) Field of Classification Search
CPC ..... E05B 63/006; E05B 17/0004; E05B 17/0012; E05B 9/002; E05B 15/16;
(Continued)

(56) References Cited

U.S. PATENT DOCUMENTS 1,888,828 A 11/1932 Moore
1,938,112 A * 12/1933 Schlage ..... E05B 63/006 70/432
(Continued)

FOREIGN PATENT DOCUMENTS

CN 1223328 7/1999
CN 1255181 5/2000
(Continued)

OTHER PUBLICATIONS

Non-Final Office Action on co-pending U.S. Appl. No. 13/909,433 dated Dec. 8, 2014.
(Continued)

*Primary Examiner* — Christine M Mills
(74) *Attorney, Agent, or Firm* — Klein, O'Neill & Singh, LLP

(57) ABSTRACT

A lockset is actuable by pivoting a handle about a longitudinal axis of the lockset by rotating the handle and by pivoting the handle about an axis transverse to the lockset axis, such as by pushing or pulling. The lockset includes an inside handle and an outside handle, each associated with an independent mechanism, each of which can independently actuate the lockset. A locking mechanism prevents actuation of a first one of the independent handle mechanisms without affecting operation of the other handle mechanism. Upon actuation of the other handle mechanism, a retractor engages a surface of the locking mechanism and removes it from engagement with the first locking mechanism. An adjustment ring has a first configuration that centers the lockset in a door having a first standard thickness and a second configuration that centers the lockset in a door having a second standard thickness.

13 Claims, 16 Drawing Sheets

(51) Int. Cl.
*E05C 1/14* (2006.01)
*E05C 1/16* (2006.01)
*E05B 1/00* (2006.01)

(52) U.S. Cl.
CPC ..... *E05B 17/0012* (2013.01); *E05B 63/0069* (2013.01); *E05C 1/14* (2013.01); *E05C 1/16* (2013.01); *Y10T 292/93* (2015.04)

(58) Field of Classification Search
CPC ..... E05B 17/0041; E05B 63/0069; E05B 1/0092; E05B 3/06; E05B 63/0056; E05C 1/14; E05C 1/16; Y10T 292/93; Y10T 292/85; Y10T 292/858; Y10T 292/96; Y10T 292/91; Y10T 292/82; Y10T 292/57; Y10T 292/06; Y10S 292/54; Y10S 292/53; Y10S 292/60; Y10S 292/64
USPC ..... 292/357, 358, 347, 336.3, 1.5, 348, 350, 292/359, DIG. 53, DIG. 54, DIG. 60, 292/DIG. 64; 70/224
See application file for complete search history.

(56) References Cited

U.S. PATENT DOCUMENTS 1,965,789 A 7/1934 Anglyn
1,967,152 A 7/1934 Lyons
2,267,939 A 12/1941 McKenzie
2,370,646 A 3/1945 Falk
2,688,181 A 9/1954 Livermont et al.
2,801,536 A 8/1957 Best
2,862,379 A 12/1958 Schafer
2,895,322 A 7/1959 Pollock
3,035,432 A 5/1962 De Vines
3,065,014 A 11/1962 Russell
3,128,115 A 4/1964 Patriquin et al.
3,161,036 A 12/1964 Himes et al.
3,490,803 A 1/1970 Rollins
3,495,861 A 2/1970 Snow
3,518,854 A 7/1970 Krantz
3,582,121 A 6/1971 Rollins
3,877,263 A 4/1975 Strickler, III et al.
3,899,907 A * 8/1975 Prahl ..... E05B 9/084 70/370
4,101,153 A 7/1978 Dozier
4,290,282 A 9/1981 Wildenradt
4,453,753 A 6/1984 Fayerman et al.
4,573,334 A * 3/1986 Crepinsek ..... E05B 63/006 70/370
4,632,439 A 12/1986 Miller
4,671,089 A 6/1987 Fleming et al.
4,763,935 A 8/1988 Bisbing
4,777,810 A 10/1988 Webster
4,976,480 A * 12/1990 Dixon ..... E05B 55/005 292/353
4,982,986 A 1/1991 Gressett, Jr. et al.
5,026,101 A 6/1991 Dotterweich et al.
5,085,474 A 2/1992 Toledo et al.
5,094,486 A 3/1992 Foster
5,157,953 A 10/1992 Hung
5,301,526 A 4/1994 Fann et al.
5,322,333 A * 6/1994 Norton, II ..... E05B 55/005 292/336.3
5,364,139 A 11/1994 Bergen et al.
5,460,419 A 10/1995 Castoldi
5,469,725 A 11/1995 Yamada
5,481,890 A 1/1996 Millman
5,516,163 A 5/1996 Baker
5,533,368 A * 7/1996 Eagan ..... E05B 63/006 33/194
5,605,064 A * 2/1997 Katayama ..... E05B 13/108 292/336.3
5,727,406 A 3/1998 Banducci
5,761,936 A * 6/1998 Katayama ..... E05B 3/065 292/336.3
5,921,117 A 7/1999 Illguth
5,934,117 A 8/1999 Shen
5,947,535 A 9/1999 Baker
5,947,537 A 9/1999 Aigner et al.
5,983,683 A * 11/1999 Shen ..... E05B 3/003 292/356
6,035,492 A 3/2000 Warshaviak
6,131,970 A * 10/2000 Hurst ..... E05B 3/003 292/336.3
6,141,998 A 11/2000 Seo
6,223,572 B1 * 5/2001 Marttinen ..... E05B 9/002 292/348
6,279,360 B1 * 8/2001 Shen ..... E05B 3/00 292/336.3
6,302,457 B1 * 10/2001 Shen ..... E05B 3/06 292/336.3
6,322,113 B1 11/2001 Ayers et al.
6,354,119 B1 3/2002 Molzer
6,360,569 B1 3/2002 Huang
6,364,383 B1 * 4/2002 Shen ..... E05B 55/005 292/336.3
6,386,602 B1 5/2002 Lan
6,553,799 B2 4/2003 Bates et al.
6,619,710 B1 * 9/2003 Hwang ..... E05B 63/006 292/336.3
6,802,194 B1 10/2004 Shen
6,868,705 B2 3/2005 Miao
6,997,024 B2 2/2006 Etlicher
7,100,406 B2 9/2006 Masseth, Jr.
7,100,407 B2 9/2006 Chen
7,712,343 B2 5/2010 Smith et al.
8,240,177 B2 8/2012 Baser
8,449,003 B2 5/2013 Bunker, II et al.
8,505,345 B2 8/2013 Sun et al.
8,690,205 B2 4/2014 Benitez et al.
8,813,530 B2 8/2014 Chiou et al.
8,833,120 B2 9/2014 Collins et al.
9,121,200 B2 9/2015 Weathersby
9,371,671 B2 6/2016 Weathersby
9,556,644 B2 1/2017 Yoon et al.
2002/0100301 A1 8/2002 Eller et al.
2002/0104345 A1 8/2002 Wang
2003/0037582 A1 2/2003 Edwards, Jr. et al.
2003/0056556 A1 * 3/2003 Park ..... E05B 3/00 70/224
2003/0121300 A1 * 7/2003 Wang ..... E05B 15/02 70/224
2005/0126236 A1 6/2005 Romero
2006/0079294 A1 4/2006 Chen
2006/0185409 A1 8/2006 Sun et al.
2006/0214436 A1 9/2006 Wheatland et al.
2007/0096479 A1 * 5/2007 Lin ..... E05B 9/08 292/336.3
2008/0168809 A1 7/2008 Liu et al.
2008/0307836 A1 * 12/2008 Kim ..... E05B 3/065 70/91
2009/0078011 A1 3/2009 Avni
2009/0152875 A1 * 6/2009 Gray ..... E05B 55/005 292/1.5
2009/0288459 A1 11/2009 Liu et al.
2010/0139335 A1 * 6/2010 Constantinou ..... E05B 3/065 70/57
2010/0307207 A1 * 12/2010 Vogel ..... E05B 55/005 70/106
2011/0225770 A1 * 9/2011 Alber ..... E05B 15/02 16/402
2011/0289987 A1 12/2011 Chiou et al.
2012/0212001 A1 * 8/2012 Benitez ..... E05B 17/22 292/251.5
2012/0267907 A1 * 10/2012 Rudhager ..... E05B 3/04 292/348
2013/0269402 A1 10/2013 Vasudevan
2014/0157843 A1 6/2014 Quan et al.
2014/0265376 A1 * 9/2014 Walls ..... E05B 55/005 292/337

(56) References Cited

U.S. PATENT DOCUMENTS

FOREIGN PATENT DOCUMENTS

| | | | |
|---|---|---|---|
| CN | 2430511 | | 5/2001 |
| CN | 2559730 | | 7/2003 |
| CN | 2641228 | | 9/2004 |
| CN | 2658315 | | 11/2004 |
| CN | 2693906 | | 4/2005 |
| CN | 101006240 | | 7/2007 |
| CN | 201210263298.6 | | 7/2012 |
| CN | 102758561 | | 10/2012 |
| CN | 102777073 | | 11/2012 |
| CN | 202755736 | U | 2/2013 |
| CN | 202788202 | U | 3/2013 |
| CN | 202788218 | U | 3/2013 |
| CN | 203308188 | U | 11/2013 |
| CN | 203403726 | U | 1/2014 |
| EP | 1679414 | | 7/2006 |
| EP | 2505750 | | 10/2012 |
| JP | 2013209805 | | 10/2013 |
| WO | WO2016033793 | | 3/2016 |
| WO | WO2016033804 | | 3/2016 |
| WO | WO2016033805 | | 3/2016 |

OTHER PUBLICATIONS

Notice of Allowance on co-pending U.S. Appl. No. 13/909,433 dated Apr. 28, 2015.
Office Action on co-pending U.S. Appl. No. 14/027,916 dated May 11, 2015.
Non-Final Office Action on co-pending U.S. Appl. No. 14/809,019 dated Sep. 14, 2015.
Notice of Allowance on co-pending U.S. Appl. No. 14/027,972 dated Oct. 7, 2015.
Final Office Action on co-pending U.S. Appl. No. 14/027,916 dated Dec. 2, 2015.
Notice of Allowance on co-pending U.S. Appl. No. 14/809,019 dated Mar. 17, 2016.
Notice of Allowance on co-pending U.S. Appl. No. 14/027,916 dated Jun. 23, 2016.
Office Action on corresponding foreign application (CA Application No. 2821533) from the Canadian Intellectual Property Office dated Feb. 1, 2017.
Office Action on co-pending Canadian patent application (CA 2959255) dated Jan. 18, 2018.
International Search Report on corresponding PCT application (PCT/CN2014/086038) from International Searching Authority (SIPO) dated May 28, 2015.
Written Opinion on corresponding PCT application (PCT/CN2014/086038) from International Searching Authority (SIPO) dated May 28, 2015.
International Search Report on corresponding PCT application (PCT/CN2014/085987) from International Searching Authority (SIPO) dated May 28, 2015.
Written Opinion on corresponding PCT application (PCT/CN2014/085987) from International Searching Authority (SIPO) dated May 28, 2015.
International Search Report on corresponding PCT application (PCT/CN2014/086039) from International Searching Authority (SIPO) dated Jun. 4, 2015.
Written Opinion on corresponding PCT application (PCT/CN2014/086039) from International Searching Authority (SIPO) dated Jun. 4, 2015.
Non-Final Office Action on co-pending U.S. Appl. No 14/933,364 dated Dec. 14, 2017.
Non-Final Office Action on co-pending U.S. Appl. No. 15/506,690 dated Jun. 11, 2018.
Office Action on co-pending Canadian patent application (CA 2959251) dated Feb. 16, 2018.
Notice of Allowance on co-pending U.S. Appl. No. 14/933,364 dated Mar. 27, 2018.

* cited by examiner

METHOD FOR INSTALLING A LOCKSET

CROSS-REFERENCE TO RELATED APPLICATION

This application is a divisional of application U.S. application Ser. No. 14/027,916, filed on Sep. 16, 2013. The disclosure of the prior application is incorporated herein by reference.

FEDERALLY SPONSORED RESEARCH OR DEVELOPMENT

Not Applicable.

BACKGROUND

The present disclosure relates to the field of locksets for doors.

Door locksets employing handles to actuate a latch bolt upon rotation of the handle have been available for years. More recently, locksets have been developed in which the latch bolt is actuated not only by rotation of the handles, but also upon pushing on or pulling a handle arm.

Although such locksets still perform the function of actuating the latch bolt, such locksets function quite differently than traditional lockset designs, and also employ different and complex structures. As such, structures traditionally used for features such as privacy locks or other types of locking mechanisms will not necessarily work well with the improved locksets. Previous designers have been unsuccessful in designing reliable and cost-effective privacy locks that work well with the improved locksets.

In some lockset embodiments, mount plates and/or cover plates are arranged on opposing sides of the door to which the lockset is mounted. As such, the door is sandwiched between the plates, and the lockset is secured in place in the door. Since doors can vary in thickness, the distance between the plates may need to be adjusted in order to obtain a proper fit. In some locksets the cover plate is threadingly connected to a spindle or housing of the lockset so that the distance between opposing plates can be adjusted by rotating one or both plates.

However, in some lockset embodiments a privacy lock or other feature may be accessed through an opening in at least one of the cover plates or mount plates. Proper access through the opening may require proper alignment of the hole with an internal feature of the lockset, which alignment is difficult or impossible when the plate is rotated to adjust the lockset to fit door thickness.

SUMMARY

There is a need in the art for a lockset that can be adjusted to obtain proper fit to doors of various thickness while maintaining a desired alignment of a lockset mounting plate or rose.

There is also a need in the art for a lockset having handle actuators that actuate the latch bolt upon rotation of a handle and/or upon pushing or pulling on a handle arm, but which also provides a privacy lock or other lock feature. There is a further need for such a lockset in which the lock can be disengaged by actuating the interior handle in any of the push, pull or rotate modes.

In accordance with one embodiment, a lockset is provided, comprising a retractor assembly having a first housing body and a first flange. The retractor assembly is configured to be fitted within a door mount hole and to be operably coupled to a latch bolt assembly so as to selectively retract a latch bolt of the latch bolt assembly. First and second mount plates are configured to attach to the retractor assembly to mount the retractor assembly to the door. The first mount plate has a first mount plate aperture configured to accommodate the housing body therethrough. An adjustment member is supported on the housing body and is interposed between the flange and the first mount plate. The adjustment member is sized so as not to fit through the first mount plate aperture. The first mount plate engages a blocking surface of the adjustment member so as to block advancement of the first mount plate toward the flange. The adjustment member can be selectively positioned in a first configuration relative to the flange or a second configuration relative to the flange. When the adjustment member is in the first configuration, the first mount plate engages the adjustment member blocking surface at a first distance from the flange. When the adjustment member is in the second configuration, the first mount plate engages the adjustment member blocking surface at a second distance from the flange.

Another embodiment additionally comprises a plurality of lugs between the adjustment member and the flange. The adjustment member has a corresponding plurality of first seats and a corresponding plurality of second seats. The lugs engage the first seats when the adjustment member is in the first configuration, and the lugs engage the second seats when the adjustment member is in the second configuration. In some embodiments the lugs comprise raised portions of the housing body. In some embodiments the lugs extend longitudinally from the flange.

In further embodiments, the adjustment member can have a flange-facing surface opposite the blocking surface. The first seats are spaced a first distance from the flange-facing surface, and the second seats are spaced a second distance from the flange-facing surface.

In additional embodiments the adjustment member comprises a ring-shaped member that encircles the housing. In some such embodiments the adjustment member has a second seat positioned between each pair of adjacent first seats about the circumference of the adjustment member. Further embodiments additionally comprise a damping member between an inner surface of the adjustment member and the housing. The damping member is configured to inhibit rattle of the adjustment member on the housing. In some embodiments the damping member is made of a different material than the adjustment member. In additional embodiments the adjustment member comprises a circumferential slot formed in an inner surface and the damping member comprises an incomplete ring that fits at least partially within the slot, wherein the damping member is partially deformed when the adjustment member is disposed on the housing.

In other embodiments the retractor assembly comprises a second housing body, a second flange that is spaced from the first flange, and a cap bolt supported by the first and second flanges. The cap bolt has an elongate body portion and an elongate threaded male portion. The male portion terminates at a male end. A diameter of the body portion is greater than a diameter of the male portion. The first flange has a hole sized so that the male portion extends therethrough but the body portion does not fit therethrough. The second flange has a hole sized so that the body portion fits therethrough. The body portion has a raised stop configured so that the body portion does not fit through the second flange hole at the raised stop, wherein a distance from the raised stop to the male end is greater than a minimum distance between the first and second flanges. In some such embodiments the distance from the raised stop to the male end of the cap bolt is no greater than a distance from a surface of the second flange that faces the first flange and a surface of the first flange that faces away from the second flange.

In accordance with another embodiment, a method of installing a lockset is provided. The method comprises determining whether a door has a first width or a second width, and moving an adjustment member relative to a retractor assembly housing so that the adjustment member is in a first position relative to the retractor assembly housing if the door has a first width and the adjustment member is in a second position relative to the retractor assembly housing if the door has a second width. A distance between a reference point on the housing and a blocking side of the adjustment member is a first distance when the adjustment member is in the first position and a second distance when the adjustment member is in the second position. The method additionally comprises advancing a first mount plate over the retractor assembly housing so that the mount plate abuts the blocking side of the adjustment member, advancing the retractor assembly through a door mount hole so that the first mount plate engages a first door surface at and adjacent the door mount hole, advancing a second mount plate over the retractor so that the second mount plate engages a second door surface opposite the first door surface, and connecting the first and second mount plates so that the retractor assembly is supported within the door mount hole.

In some such embodiments, the retractor assembly is supported generally centered within the door mount hole. In some embodiments the difference between the first and second distance is half the difference between the first and second door widths.

In additional embodiments the adjustment member is ring-shaped and has a plurality of first seats and a plurality of second seats, and the retractor assembly housing comprises a plurality of lugs. In some such embodiments moving the adjustment member so that the adjustment member is in the first position comprises moving the adjustment member rotatably so that a plurality of the lugs are aligned with the plurality of seats, and moving the adjustment member linearly so that the plurality of the lugs are engaged by the plurality of first seats.

In further embodiments the first mount plate is secured to the retractor assembly and abutting the blocking side of the adjustment member, and the adjustment member is in the first position. If it is determined that the door has the second width, the step of moving the adjustment member comprises releasing the first mount plate from the retractor assembly, moving the first mount plate out of contact with the adjustment member, and moving the adjustment member over the retractor assembly from the first position to the second position.

In another embodiment, connecting the first and second mount plates comprises securing the second mount plate to the retractor assembly and securing the first mount plate to the retractor assembly. In some such embodiments securing the first mount plate to the retractor assembly comprises threading a male end of a first cap bolt with a first boss of the first mount plate so that a first stop of the first cap bolt engages a first flange of the retractor assembly. In some embodiments, when threading the first cap bolt with the first boss, a second cap bolt is supported by the first and a second flange of the retractor assembly so that a second stop of the second cap bolt engages the second flange of the retractor assembly and a male end of the second cap bolt is positioned within a hole of the first flange.

In accordance with yet another embodiment, a lockset comprises a first actuating mechanism and a second actuating mechanism. The first actuation mechanism is configured to receive an input from a first handle so that when the first handle is actuated, the first actuating mechanism urges a first retractor arm to rotate. The second actuating mechanism is configured to receive an input from a second handle so that when the second handle is actuated, the second actuating mechanism urges a second retractor arm to rotate. The first and second retractor arms are disposed on opposite sides of a lockset axis. A retractor is constrained so as to be movable in a direction transverse to the lockset axis. The retractor has first and second ends. The first retractor arm extends through the first end of the retractor so that a distal end of the first retractor arm is within the retractor. When the first retractor arm rotates, the first retractor arm distal end engages a contact surface of the retractor and urges the retractor to move in the direction transverse to the lockset axis. The second retractor arm extends through the second end of the retractor so that a distal end of the second retractor arm is within the retractor. When the second retractor arm rotates, the second retractor arm distal end engages the contact surface of the retractor and urges the retractor to move in the direction transverse to the lockset axis. An elongate locking member is movable between a locked position and an unlocked position. A control arm extends from and moves with the locking member. The control arm has a lock portion configured so that when the locking member is in the locked position the lock portion blocks the second retractor arm from rotating sufficient to engage the retractor contact surface. The first retractor arm is not blocked from rotation when the locking member is in the locked position. The control arm is configured so that when the retractor is moved by the first retractor arm when the locking member is in the locked position. The moving retractor engages a control surface that is attached to the locking member so as to urge the locking member from the locked position toward the unlocked position.

In additional embodiments the first end of the retractor comprises a recessed portion, and a portion of the control arm is disposed in the retractor recessed portion when the locking member is in the locked position, but the portion of the control arm is outside of the actuator recessed portion when the locking member is in the unlocked position.

In additional embodiments, the retractor comprises a spring boss between the first and second ends, and the spring boss is closer to the second end than to the first end. In further embodiments, the spring boss is centered between the recessed portion and the second end.

In yet additional embodiments, the elongate locking member is spaced from the lockset axis and moves longitudinally parallel to the lockset axis when moving between the locked and unlocked positions.

In some embodiments the elongate locking member comprises an elongate actuator bar, and the lockset additionally comprises a first mount plate having a first aperture. The actuator bar extends through the first aperture so that a user can manually push the elongate actuator bar to urge the locking member from the unlocked position to the locked position.

Some embodiments additionally comprise a second mount plate having a second aperture. The elongate actuator bar does not extend through the second aperture. A tool that is configured to be advanced through the aperture is provided and used to push the elongate actuator bar so as to urge the locking member from the locked position to the unlocked position. In some embodiments the tool is a key.

In yet further embodiments, the elongate locking member engages a lock detent at the locked position and an unlock detent at the unlocked position.

In still further embodiments the control arm comprises a distal portion and a proximal portion. The distal portion is spaced to the same side of the lockset axis as the second retractor arm. In some such embodiments, the proximal portion of the control arm comprises the control surface, and the control surface extends at an angle oblique to the lockset axis. In further embodiments, the first retractor arm rotates within a first plane, and the control surface is disposed within the first plane.

In additional embodiments, the recessed portion of the retractor first end slides over the control surface.

Further embodiments additionally comprise a first spacing member configured to keep the first retractor arm on a first side of the lockset axis and a second spacing member configured to keep the second retractor arm on a second side of the lockset axis.

In yet additional embodiments, the second retractor arm comprises a cavity configured to receive a lock portion of the control arm.

In still further embodiments, each of the first and second actuating mechanisms comprises a handle connected to an input member. The input member has a camming surface. The handle and input member pivot about an axis of the lockset and pivot about an axis transverse to the lockset axis. The input member camming surface is configured to engage a pusher member. The pusher member is configured to be blocked from rotating relative to a first housing so that pivoting of the input member is translated into longitudinal translation of the pusher member. The pusher member is engaged with the respective retractor arm so that longitudinal translation of the pusher member urges the retractor arm to rotate.

In yet another embodiment, a method of operating a lockset is provided. The lockset has first and second actuating mechanisms that are configured so that when one of a first handle and a second handle is actuated, a respective first or second retractor arm is urged to rotate. The method comprises moving an elongate locking member from an unlocked position to a locked position, and actuating the first handle so as to move the locking member from the locked position to the unlocked position. When the locking member is moved to the locked position, a control arm that extends from and moves with the elongate locking member is moved into a blocking position at which the control arm blocks the second retractor arm from rotating. The elongate locking member has a locking member axis that is spaced from a lockset axis. When actuating the first handle so that the first retractor arm rotates, a portion of the first retractor arm engages a retractor so as to push the retractor in an opening direction that is transverse to the lockset axis. As the retractor moves in the opening direction the retractor engages a control surface that is attached to the locking member. The control surface is disposed at an angle oblique to the opening direction, so that as the retractor moves in the opening direction the retractor engages and slides over the control surface, pushing the control surface and locking member toward the unlocked position.

In some embodiments the retractor has a first end having a recessed portion, and when the locking member is moved from the unlocked position to the locked position, the control arm is moved into the recessed portion. In additional embodiments, the control surface extends obliquely from the control arm, and when the retractor moves in the opening direction, the recessed portion of the retractor engages and slides over the control surface.

In further embodiments, the control arm has a wedge-shaped control portion, and the control surface is disposed on an edge of the wedge-shaped control portion.

In yet further embodiments, moving the locking member from the locked position to the unlocked position moves the control arm away from the blocking position, so that the second retractor arm is no longer blocked from rotating.

DETAILED DESCRIPTION

Figure 1B:
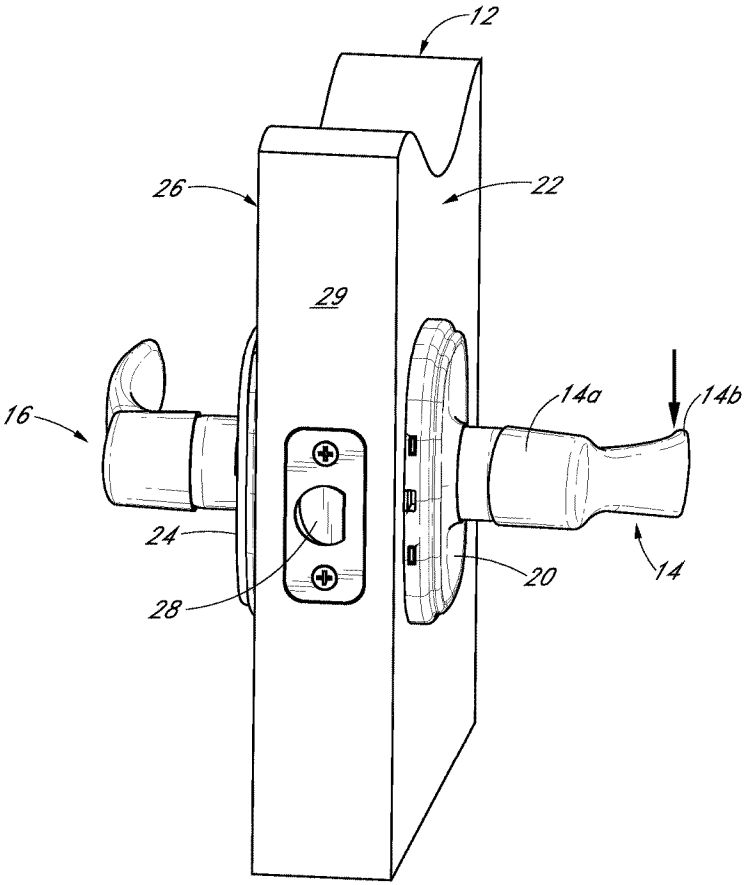
FIG. 1B shows the assembly of FIG. 1A in a configuration in which a latch bolt of the lockset has been retracted by rotation of a door handle of the lockset.
Figure 1A:
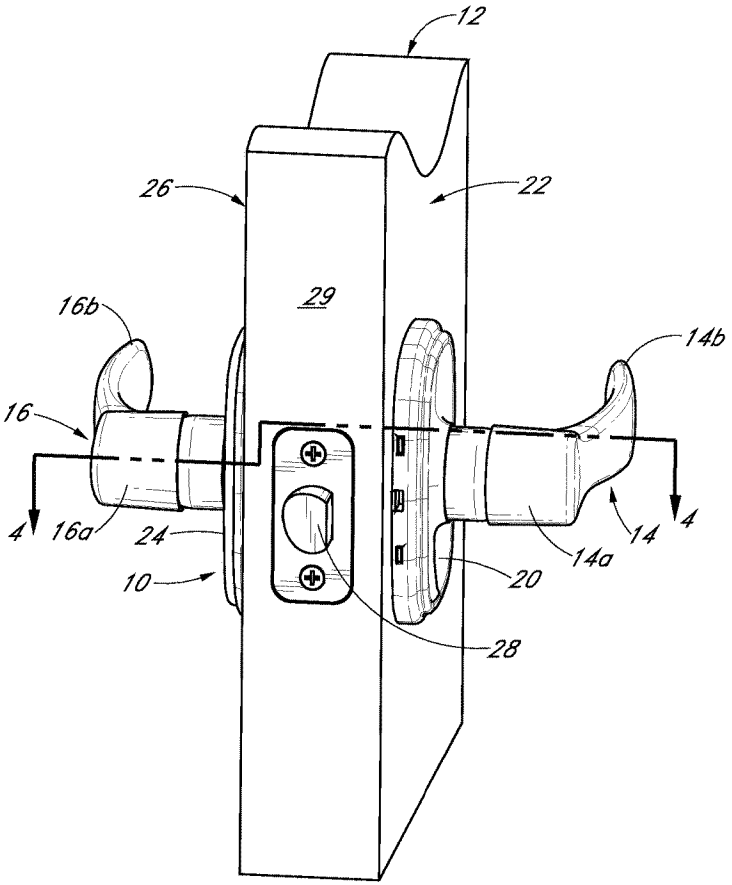
FIG. 1A shows a perspective view of a lockset in accordance with the present disclosure installed in a door.

FIG. 1A shows a perspective view of a lockset 10, in accordance with a preferred embodiment of the present disclosure, installed on a door 12. The illustrated lockset 10 has an inside handle 14 and an outside handle 16. Each of the handles has a body portion 14*a*, 16*a* and an arm portion 14*b*, 16*b* that extends from the body portion 14*a*, 16*a*. An inside cover plate 20, or rose, is adjacent an inside face 22 of the door, and an outside cover plate 24, or rose, is adjacent an outside face 26 of the door 12. With additional reference to FIGS. 2, 3 and 6, the inside and outside roses 20, 24 each cover a respective inside and outside mounting plate 46, 44, which mounting plates engage the door 12. A latch bolt 28 extends from an edge surface 29 of the door 12 in a conventional manner.

With reference next to FIG. 1B, the inside handle 14 is shown being rotated about an axis of the lockset, as the user pushes the handle arm 14*b* downwardly. As shown, such rotation actuates the lockset so as to retract the latch bolt 28. It is to be understood that upward rotation of the handle arm will similarly actuate the lockset so as to retract the latch bolt, as will similar rotation of the outside handle 16.

Figure 1D:
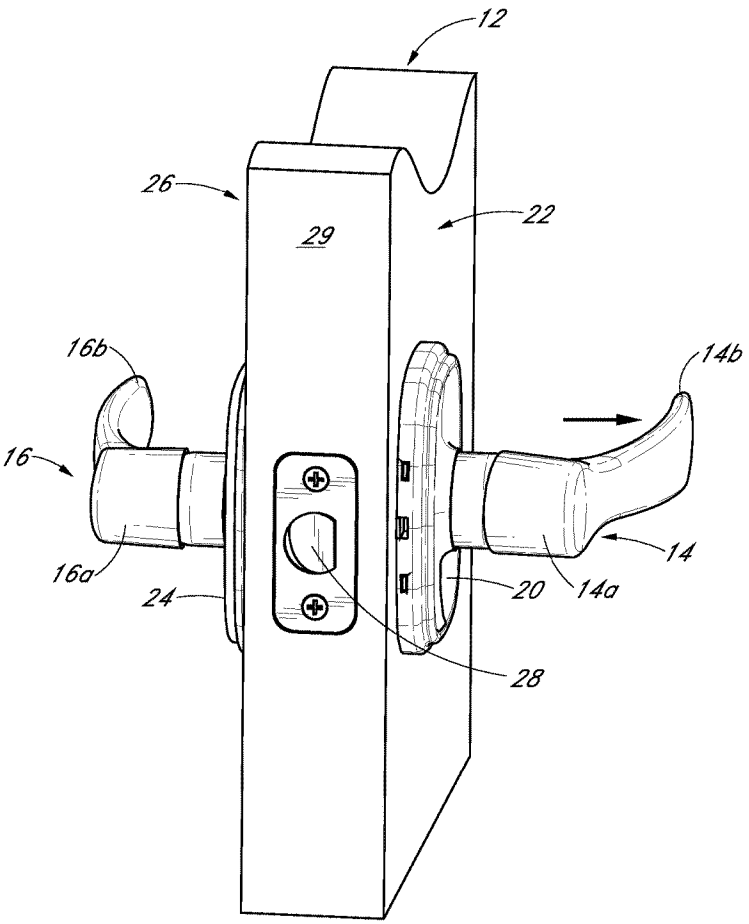
FIG. 1D shows the assembly of FIG. 1A in a configuration in which a latch bolt of the lockset has been retracted by pulling on a door handle of the lockset.
Figure 1C:
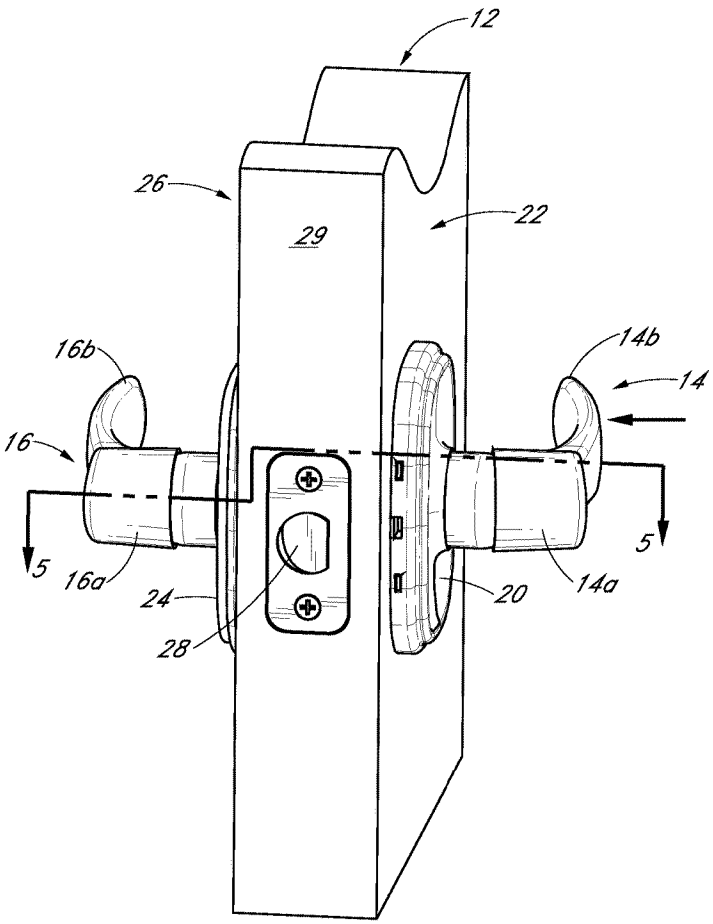
FIG. 1C shows the assembly of FIG. 1A in a configuration in which a latch bolt of the lockset has been retracted by pushing on a door handle of the lockset.

With reference next to FIG. 1C, a configuration is shown in which the inside handle arm 14*b* has been pushed toward the door 12, thus causing the inside handle 14 to pivot about an axis transverse to the lockset axis. Similarly, FIG. 1D shows the inside arm 14*b* being pulled away from the door 12, thus causing the inside handle 14 to pivot about an axis transverse to the lockset axis. As shown, such pivoting also actuates the lockset 10 so as to retract the latch bolt 28. It is to be understood that similar pushing and pulling of the outside handle arm 16*b* to pivot the outside handle will similarly actuate the lockset so as to retract the latch bolt 28.

Figure 2:
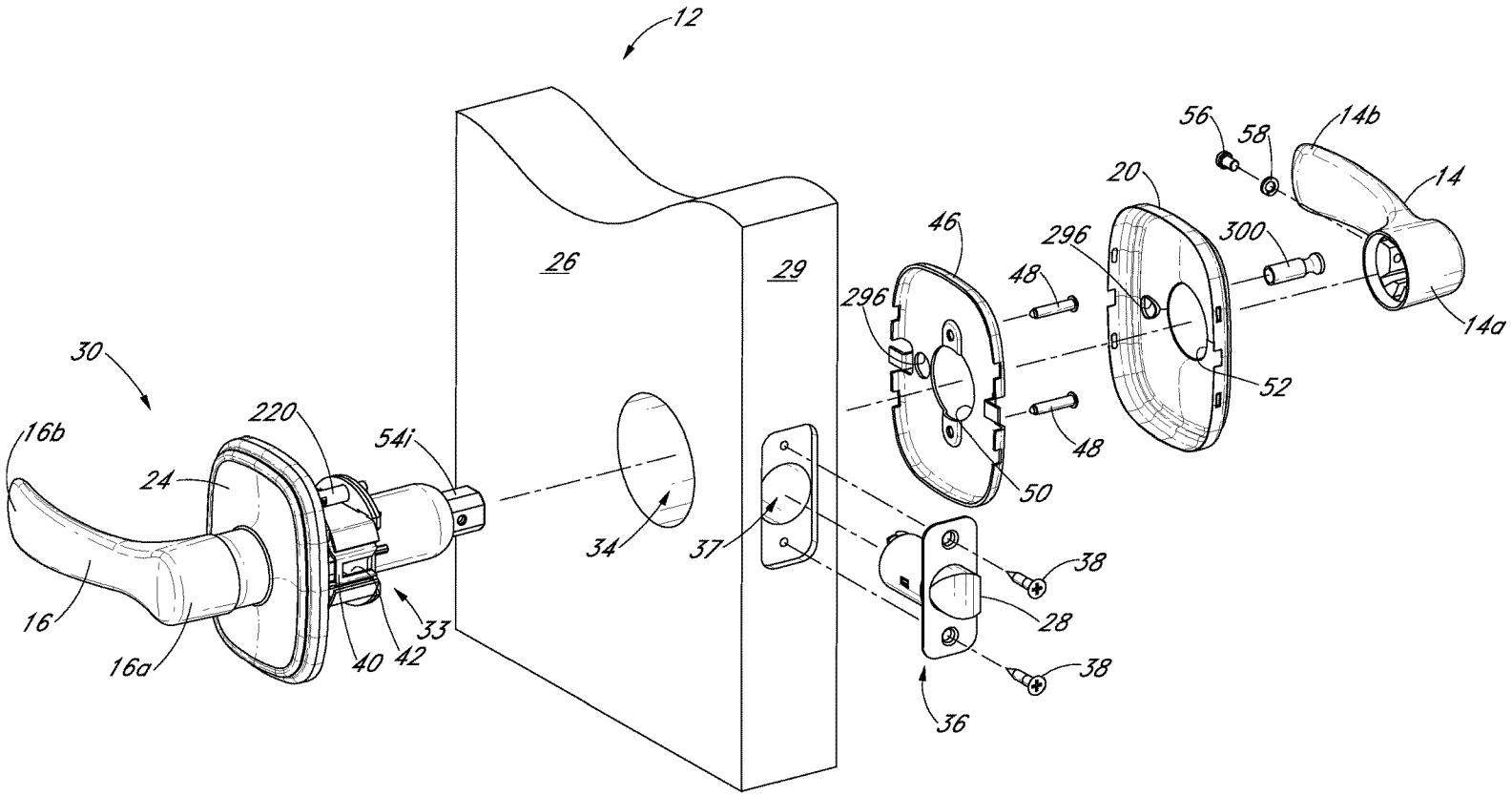
FIG. 2 shows a partially exploded perspective view of the assembly of FIG. 1A.

With reference next to FIG. 2, the lockset 10 preferably comprises an outside handle assembly 30 that may, in some embodiments, be provided preassembled when the lockset 10 is provided to installers. As shown, the outside handle assembly 30 includes the outside handle 16, outside rose 24, and a retractor assembly 33. The retractor assembly 33 extends through the outside rose 24 and is connected to the outside handle 16. The retractor assembly 33 also fits through a door mount hole 34. A latch bolt assembly 36 having the latch bolt 28 fits through a door latch bolt hole 37 and can be held in place by screws 38. A retractor 40 of the retractor assembly 33 has a latch bolt receiver slot 42 that engages the latch bolt assembly 36 so that movement of the retractor 40 also moves the latch bolt 28.

Figure 3:
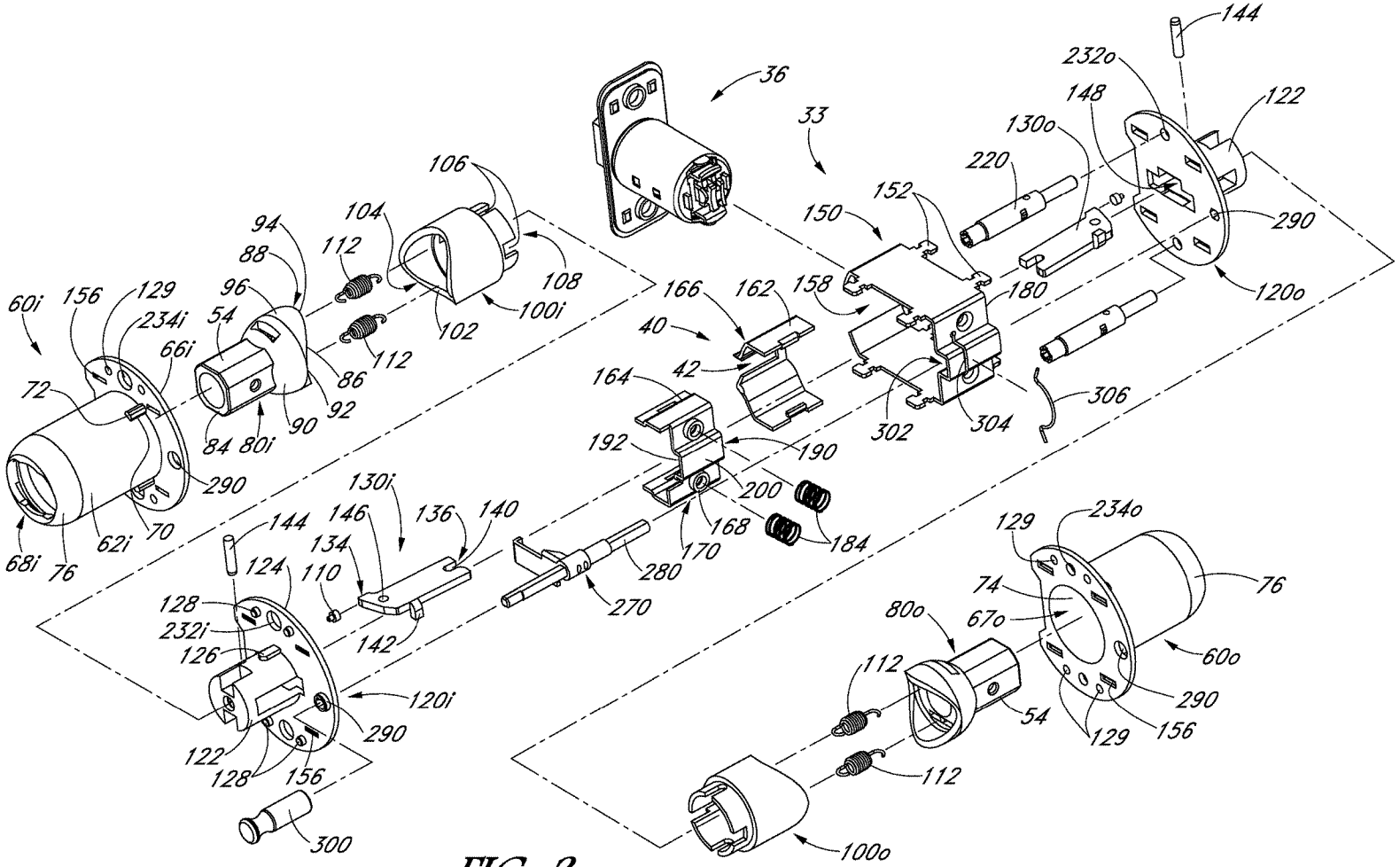
FIG. 3 shows an exploded perspective view of a retractor assembly of a lockset in accordance with an embodiment of the present disclosure.

The outside handle assembly 30 is fit through the door mount hole 34 so that the outside rose 24 (which may be integrally or releasably connected to an outside mount plate 44 as shown in FIG. 3) engages the outside surface 26 of the door 12. An inside mount plate 46 engages the inside surface 22 of the door, and mount bolts 48 engage the retractor assembly 33 so that the door 12 is sandwiched between the inside mount plate 46 and the outside rose/mount plate 24/44. The inside rose 20 can be attached to the inside mount plate 46. A portion of the retractor assembly 33 extends through an inside mount plate 50 aperture and inside rose aperture 52. The body 14*a* of the inside handle 14 is fit onto an inside handle connector 54*i* of the retractor assembly 33, and a handle bolt 56 and washer 58 can hold the inside handle 14 in place.

There are several styles and designs for locksets, and it is anticipated that other structures can be employed than are specifically illustrated in the drawings, For example, some embodiments may not employ an inside cover plate, or rose, and in some embodiments the inside cover plate may be connected to the mounting plate by, for example, an interference fit between the circumference of the mounting plate and a mating inside surface of the cover plate. In other embodiments a leaf spring may be dimensioned and located to exert a force to the inside diameter of the cover plate to retain it in place. In further embodiments the mounting plate and inside cover may be formed as a single, unitary component. Further, the inside and outside cover plates can have various decorative shapes and sizes.

FIG. 3 shows an exploded perspective view of the retractor assembly 33 of the lockset 10 and its major components. In the illustrated embodiment, certain components of the lockset retractor assembly are quite similar in structure. As such, in the drawings reference numbers for components associated with actuating the retractor assembly via the inside handle include the appellation "i" and reference numbers for components associated with actuating the retractor assembly via the outside handle will include the appellation "o". In this discussion, the generic reference number will usually be used when discussing structure that can apply to both inside and outside components. Although such components may be quite similar in structure, they may include some differences, which can be discussed below.

Continuing with reference to FIG. 3, the retractor assembly includes inside and outside elongate housings 60, each having a housing body 62 and a housing flange 66. Each housing 60 is tubular, having a flange opening 67 and a connector opening 68. Raised lugs 70 on each housing body 62 extend from the flange 66 and terminate at lug ends 72. Preferably each housing 60 has a plurality of lugs 70, which lugs each are substantially the same longitudinal length.

In the illustrated embodiment the connector opening 68 has a major axis that is greater than a minor axis. The housing 60 has a constant inner diameter along most of its length, but the inner diameter reduces at and adjacent the connector opening 68 so that at least the minor axis of the connector opening 68 has a lesser diameter than the flange opening 67. The zone within the housing 60 in which the inner diameter reduces can be labeled a back stop zone 76.

An input member 80 has a handle connector 54 at a first end 84 and an arcuate camming surface 86 at a second end 88. A back stop surface 90 is interposed between the handle connector 54 and a proximal-most point 92 of the camming surface 86. In the illustrated embodiment the back stop surface 90 has an arcuate shape about the circumference of the input member 80. Along the length of the input member from the back stop surface 90 to a distal-most point 94 of the camming surface 86, the input member 80 is cylindrical, having an input member diameter, and an outer surface that defines a side stop surface 96.

A pusher member 100 is generally cylindrical and tubular and has an arcuate camming surface 102 on a first end 104 that is configured to engage the input member camming surface 86. Longitudinal slots 106 extend from a second end 108 of the pusher member 100. A contact 110 can fit into one of the slots 106.

In the illustrated embodiment, a pair of springs 112 extend between and are connected to the input member 80 and the pusher member 100 so as to bias the pusher member 100 and input member 80 into engagement with one another, and more specifically to bias the pusher member 100 and input member 80 into engagement with one another so that their respective camming surfaces 86, 102 are aligned.

With continued reference to FIG. 3, a cap 120 comprises an elongate, generally-cylindrical cap body 122 and a cap flange 124. Lugs 126 comprise elongate, raised portions of the cap body 122 that extend from the cap flange 124. The cap flange 124 engages the housing flange 66 so that the cap body 122 extends into the housing 60. In the illustrated embodiment the cap flange 124 has a plurality of projections 128 that extend outwardly from a surface of the cap flange 124 and which register in corresponding cavities 129 formed in a surface of the associated housing flange 66. As such, when engaged, the cap 120 and housing 60 will not rotate relative to one another. The cap flange 124 and housing flange 66 are attached to one another in a manner to be discussed below.

Figure 4:
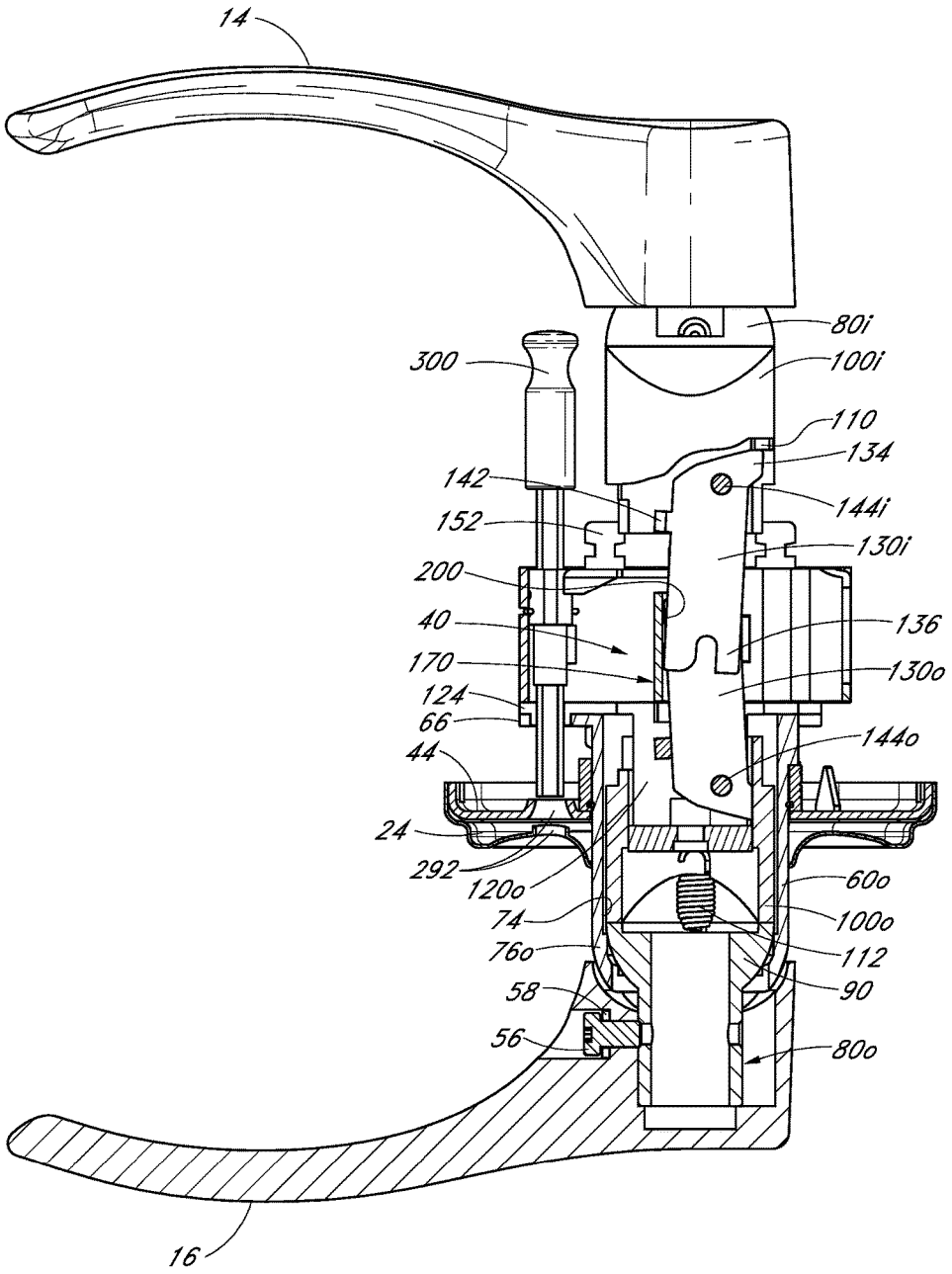
FIG. 4 shows a partial cross-sectional view taken along line 4-4 of FIG. 1A and partially cutaway, with some components removed and a locking member in an unlocked position.

FIG. 4 shows the lockset 10 fully assembled. However, portions of the lockset associated with the outside side are depicted in cross-section. Also, in order to aid illustration the inside housing, inside cap, inside mount plate and inside rose have been removed, and the inside pusher member 100 has been partially cutaway.

With continued reference to FIG. 3 and FIG. 4, the input member 80 fits within the respective housing 60 so that the handle connector 54 extends through the connector opening 68 of the housing 60 and the input member back stop surface 90 engages the inner surface 74 of the housing 60 in the back stop zone 76. The pusher member 100 also fits in the housing adjacent the input member 80. An inner diameter of the pusher member 100 is greater than an outer diameter of the cap body 122 so that the cap body 122 is partially received within the pusher member 100. Preferably slots 106 of the pusher member 100 engage lugs 126 of the cap 120. The lugs 126, engaged in the slots 106, allow longitudinal sliding of the pusher member 100 over the cap body 122, but prevent the pusher member 100 from rotating relative to the cap body 122. Preferably the second end 108 of the pusher member 100 is spaced from the cap flange 124, providing longitudinal space for the pusher member 100 to slide over the cap body 122.

As just discussed, the pusher member is prevented from rotating relative to the cap. Also, since the input member back stop surface 90 is engaged with the housing inner surface 74 in the back stop zone 76, the input member 80 is prevented from translating longitudinally in a direction toward the associated handle. As such, when the input member 80 rotates relative to the pusher member 100, engagement of the camming surfaces 86, 102 of the input member 80 and pusher member 100 forces the pusher member to move longitudinally away from the handle 14, 16.

In the illustrated embodiment, the handle 14, 16 is attached to the handle connector 54 so that the arm of the handle extends in a direction aligned with the proximal-most point 92 of the input member camming surface 86. With specific reference next to FIG. 5, when the handle arm 14*b* is pushed as is shown in FIG. 1C, the input member 80*i* pivots about an axis that is parallel to the distal-most points 94*i* of the camming surface 86*i*. The arcuate shape of the input member back stop surface 90 enables the input member 80 to pivot in this manner within the housing 60. As noted above, the input member 80 fits within the housing 60 so that the input member back stop surface 90 engages the inner surface 74 of the housing 60 in the back stop zone 76. Thus, during such pivoting the proximal-most point 92*i* of the input member camming surface 86 moves longitudinally, correspondingly pushing the pusher member 100*i* longitudinally. Thus, pushing the handle arm 14*b* has the effect of moving the pusher member 100*i* longitudinally. It is to be understood that a similar interaction of the input member and pusher member occurs when the handle arm is pulled as in FIG. 1D.

The input member 80*i* is also rotatable within the housing about the lockset axis. During such rotation, such as when the handle 14 is rotated as shown in FIG. 1B, the curving input member camming surface 86*i* engages the curving pusher member camming surface 102*i*. As discussed above, the pusher member 100*i* is prevented from rotating relative to the cap 120*i*. Also, since the input member back stop surface 90*i* is engaged with the housing inner surface 74*i* in the back stop zone 76*i*, the input member 80*i* is prevented from translating longitudinally. As such, when the input member 80*i* rotates relative to the pusher member 100*i*, engagement of the camming surfaces 86*i*, 102*i* of the input member 80*i* and pusher member 100*i* force the pusher member 100*i* to move longitudinally away from the handle 14.

Thus, whether the handle arm 14*b* is rotated, pushed, or pulled, the associated pusher member 100*i* will be moved longitudinally.

Figure 5:
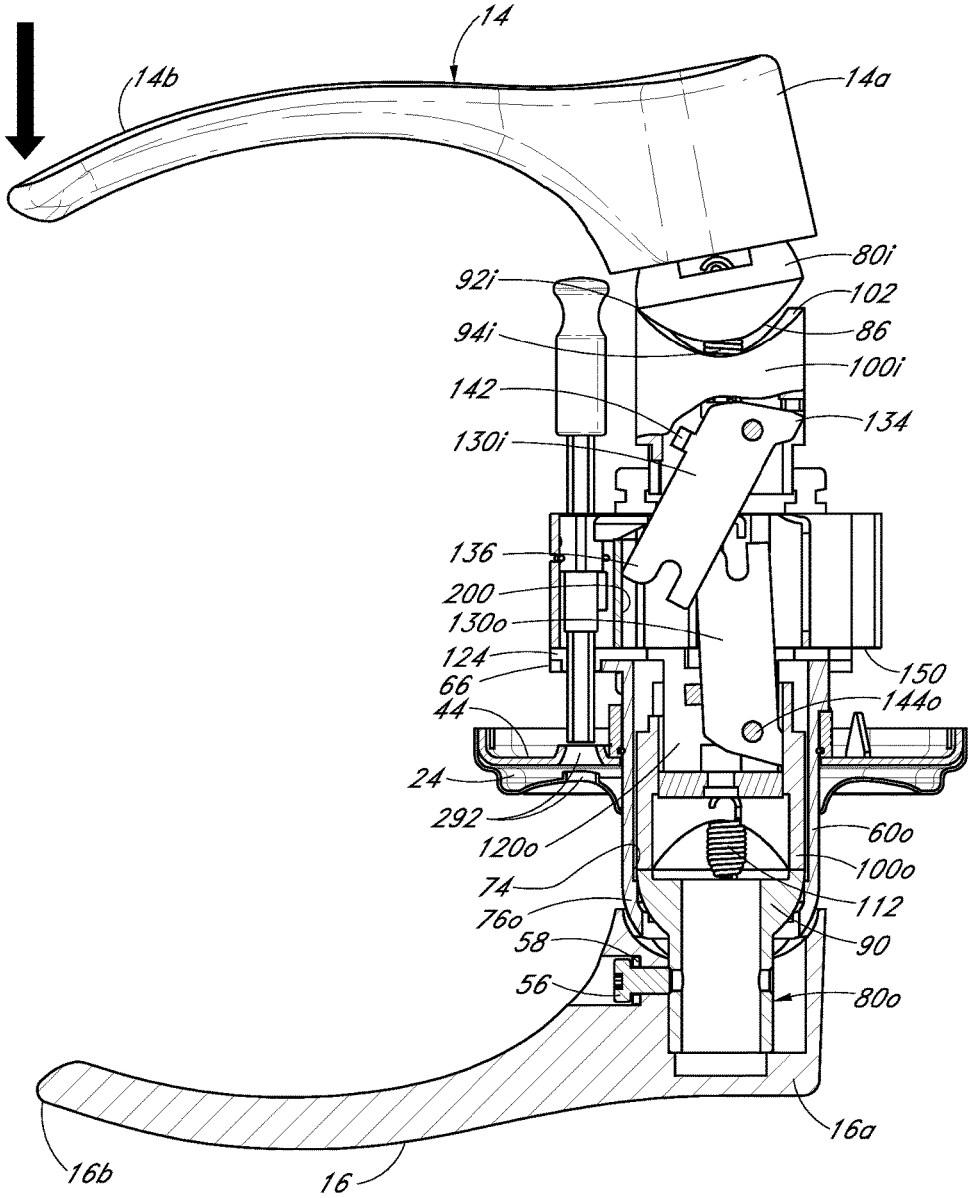
FIG. 5 shows a partial cross-sectional view taken along line 5-5 of FIG. 1C and partially cutaway, with some components removed.

With continued reference to FIGS. 3-5, the housing inner diameter is only nominally greater than the input member diameter. As such, when the input member 80 is within the housing 60, the outer surface, or side stop surface 96, of the input member is directly adjacent the housing inner surface 74. In this configuration, if the input member 80 is urged to pivot about an axis parallel to a line through the proximal-most points 92 of the camming surface, the side stop surface 96 engages the housing inner surface 74, thus preventing such pivoting. As such, if for example the handle 14, 16 were attached to the handle connector 54 incorrectly, the input member 80 would not pivot when the handle arm 14*b*, 16*b* is pushed or pulled.

With continued reference to FIGS. 3-5, a retractor arm 130 preferably has an elongate, flat body and extends from a lever end 134 to an actuator end 136. A lock receiver slot 140 is disposed on the actuator end 136, and a lateral spacer 142 extends outwardly from the retractor arm 130 in a direction transverse to the plane of the flat body. An axle 144 extends through an axle hole 146 in the retractor arm body and is supported by an axle receiver 147 (see FIG. 15) in the cap body 122. As such, the retractor arm 130 is rotatably supported in a cavity 148 defined within the cap body 122. The retractor arm 130 extends from the cap body cavity 148 so that the actuator end 136 is outside of the cap body cavity 148. The cap body cavity comprises spaced apart opposing walls. The lateral spacer 142 keeps the retractor arm 130 closer to one of the walls than to the other so that the retractor arm 130 is maintained on a first side of the cavity and offset to a side of the lockset axis.

The lever end 134 of the retractor arm 130 is aligned with a slot 106 of the pusher member 100. In the illustrated embodiment the lever end 134 is aligned with the contact 110, which is supported in one of the pusher member slots 106. As such, when the pusher member 100 is urged longitudinally, such as from the position depicted in FIG. 4 to the position depicted in FIG. 5, the pusher member 100 pushes the lever end 134 of the retractor arm 130, which causes the retractor arm 130 to rotate about the axle 144, and correspondingly causes the actuator end 136 of the retractor arm 130 to move along a curving path.

In the illustrated embodiment a casing 150 has a plurality of tabs 152. Corresponding slots 156 are formed through the engaged cap flanges 124 and housing flanges 66. The casing tabs 152 extend through the corresponding slots 156 and can then be twisted to lock them in place. As such, the inside cap flange 124*i*/housing flange 66*i* and the outside cap flange 124*o*/housing flange 66*o* are connected via the casing 150. The casing 150 further has an opening 158 on a side of the casing facing the latch bolt assembly.

The retractor 40 fits within the casing 150. In the illustrated embodiment the retractor 40 comprises first 162 and second 164 separately-made bodies that are joined together to form the retractor 40. In other embodiments the retractor 40 may be unitarily formed. The latch receiver slot 42 is formed at a first end 166 of the retractor and is aligned with the opening 158 in the casing 150. A pair of spring bosses 168 is formed at the second end 170 of the retractor 40. Corresponding spring bosses 180 are formed in the casing 150 so that a pair of springs 184 extends between the casing 150 and retractor 40 to bias the retractor 40 toward the casing opening 158. A retractor arm receiving zone 190 is defined at the second end 170 of the retractor 40. In the illustrated embodiment the receiving zone 190 is defined by a pair of spaced-apart walls 192 and an engagement surface 200.

Continuing with reference to FIGS. 3-5, The retractor arms 130 extend from their respective cap cavities so that the actuator ends 136 of the retractor arms 130 are within the retractor 40, and more preferably within the retractor arm receiving zone 190 of the retractor. As shown in FIGS. 4 and 5, the actuator ends 136 of the inside and outside retractor arms 130*i*, 130*o* are positioned adjacent one another. More precisely, they each lie on opposing sides of the lockset axis. Additionally, each of the inside and outside retractor arms rotates within a plane. Such planes of rotation are adjacent one another and on opposing sides of the lockset axis.

When the inside handle 14 is rotated or pivoted, the inside retractor arm 130*i* is forced to rotate as depicted in FIG. 5. The inside retractor arm actuator end 136 thus engages the retractor engagement surface 200, pushing the retractor 40 away from the casing opening 158 and retracting the latch bolt 28. Similarly, when the outside handle 16 is rotated or pivoted, the outside retractor arm 130*o* is forced to rotate. The outside retractor arm actuator end 136 thus engages the retractor engagement surface 200, pushing the retractor 40 away from the casing opening 158 and retracting the latch bolt 28. Thus, actuating either handle has the effect of retracting the latch bolt, and operation of the components associated with one handle is independent of operation of the components associated with the other handle.

In the illustrated embodiment, each retractor arm's lateral spacer 142 urges the arm to a side of its respective cap cavity. In other embodiments, other structures, such as a bushing on the arm, an offset cap cavity or a dividing wall within the retractor, can be employed to keep the inside and outside retractor arms from interfering with one another.

Figure 6:
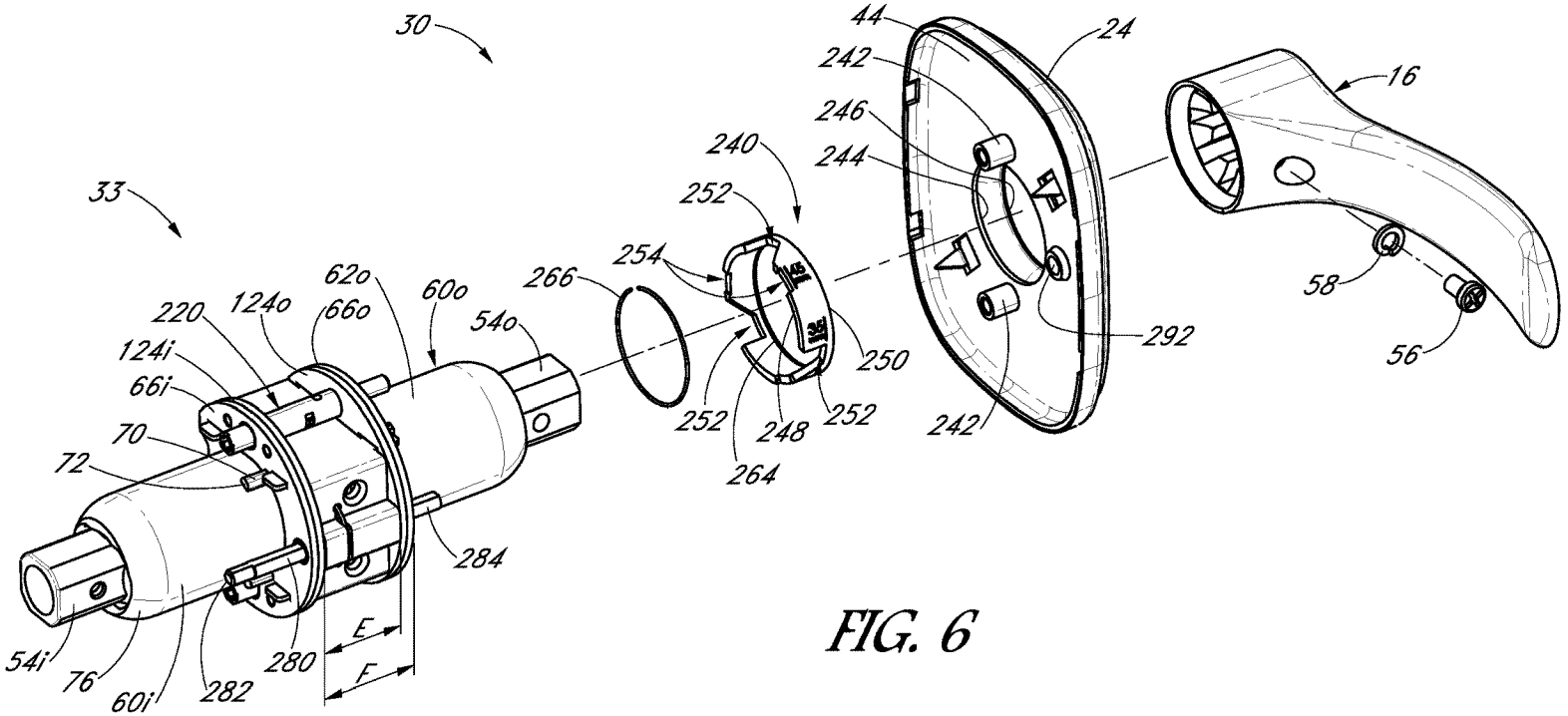
FIG. 6 shows a partially exploded perspective view of a portion of a lockset in accordance with an embodiment of the present disclosure.
Figure 13:
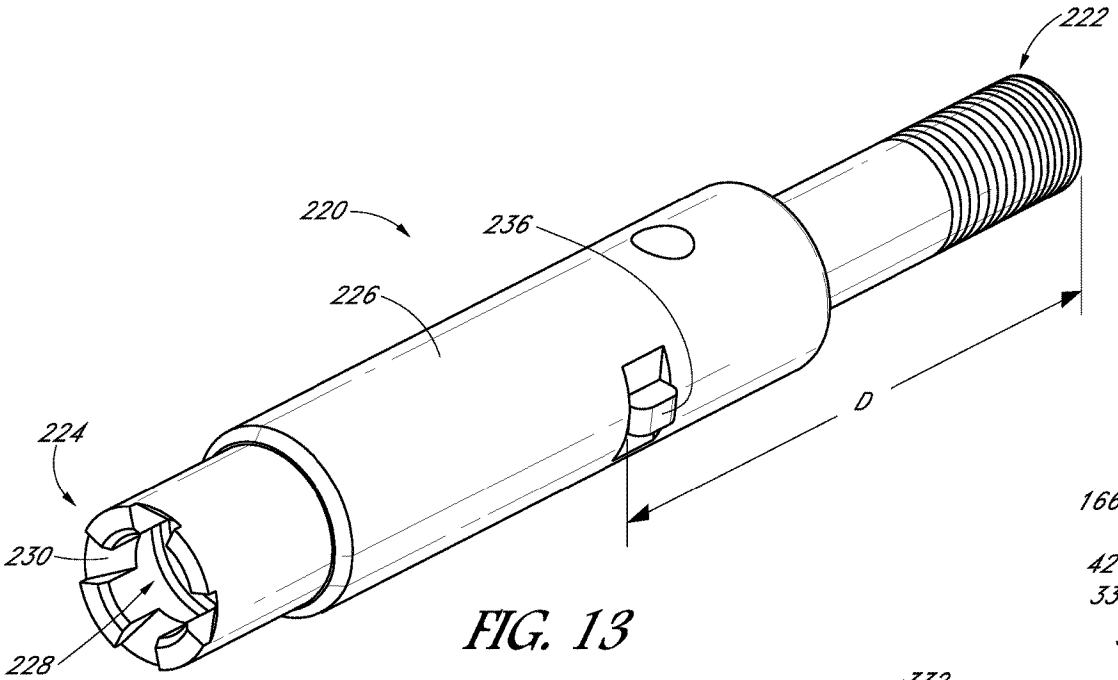
FIG. 13 is a perspective view of a cap bolt having features in accordance with an embodiment.
Figure 14:
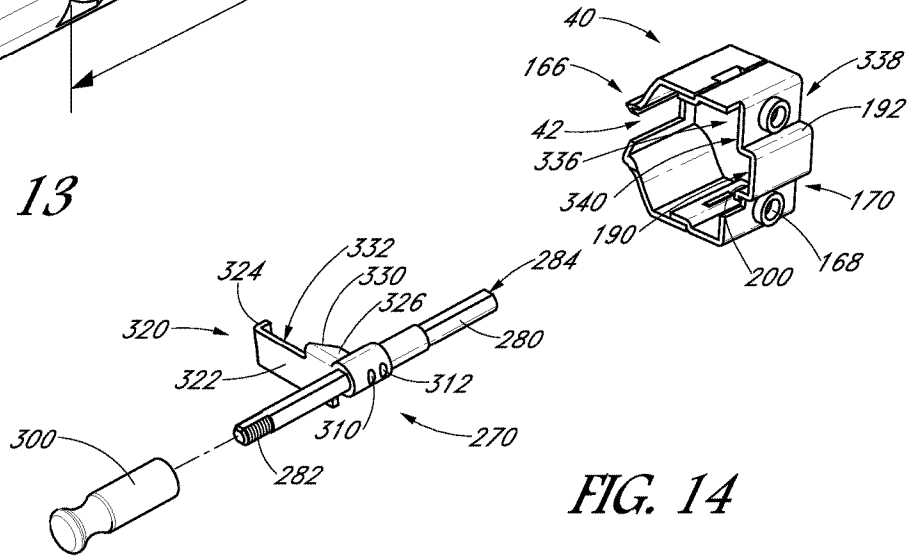
FIG. 14 is a perspective view of a locking member and retractor having features in accordance with an embodiment.

With reference again to FIG. 3 and additional reference to FIGS. 6 and 13, each of a pair of elongate cap bolts 220 has a male end 222 and a female end 224. The male end 222 is externally threaded and has a first diameter. A body 226 of the cap bolt 220 has a second diameter greater than the first diameter. The female end 224 has an internally threaded aperture 228. In the illustrated embodiment, the female end 224 also includes a screwdriver receiver portion 230 that is configured to receive a Philips head screwdriver. In additional embodiments the female end may be configured to receive other types of drivers, such as a flathead screwdriver, nut driver or the like, and/or may be externally shaped to receive a wrench, socket or the like.

As shown in FIG. 3, the inside cap flange 124*i* and inside housing flange 66*i* each have holes 232*i*, 234*i* sized to receive the male ends 222 of the cap bolts 220 fitted therethrough. However, the holes 232*i*, 234*i* have a diameter less than the cap bolt body diameter so that the body 226 is stopped from fitting therethrough. The outside cap flange 124*o* and outside housing flange 66*o* each have holes 232*o*, 234*o* sized to receive the larger-diameter body 226 extending therethrough.

Each cap bolt body 226 has a stop 236 formed thereon. The stop 236 projects radially outwardly so that as the cap bolt body 226 slides through the outside cap flange hole 232*o*, the stop 236 will engaged the cap flange 124*o* and prevent the cap bolt 220 from sliding further through the cap flange hole 232*o*. In this manner, and with additional reference to FIG. 6, the cap bolts 220 extend through and between the engaged inside housing flange 66*i* and engaged outside housing flange 66*o* when the retractor assembly 33 is assembled.

With continued reference to FIGS. 6 and 13, in some embodiments a distance D from the male end 222 of the cap bolt 220 to the side of the stop 236 opposite the male end 222 is greater than a distance E from the inside handle-facing surface of the outside cap flange 124*o* to the outside handle-facing surface of the inside cap flange 124*i*. As such, the cap bolt 220 will be retained on the assembled retractor assembly 33, and will not fall out of place even when the cap bolts 220 are not threadingly attached to or engaged with other components. In some embodiments distance D is about the same as or less than a distance F measured from the outside handle-facing surface of the inside cap flange 124*i* to the outside handle-facing surface of the outside housing flange 66*o*. As such, the male end 222 of the cap bolt 220 can lie flush with (or be recessed relative to) the outside handle-facing surface of the outside housing flange 66*o*. Most preferably, distance D is greater than E but about the same as or less than F.

With continued reference to FIG. 6, an exploded view of the outside handle assembly 30 is provided. As shown, the outside handle assembly 30 includes the fully-assembled retractor assembly 33. An adjustment member 240, which in the illustrated embodiment can be called an adjustment ring, slidingly fits over the outside housing body 62*o*. In the illustrated embodiment the mount plate 44 comprises a pair of threaded bosses 242 configured to receive the threaded male ends 222 of the cap bolts 220. The mount plate 44 has an aperture 244 sized to accommodate the housing 60 extending therethrough. Preferably, however, the mount plate aperture 244 has a diameter less than an outer diameter of the adjustment ring 240 so that the adjustment ring will not fit through the mount plate aperture 244. The rose 24 also has an aperture 246 sized to accommodate the housing 60 extending therethrough. The outside handle 16 is attached to the handle connector 54*o* of the retractor assembly 33. In the illustrated embodiment, the rose and mount plate are permanently attached to one another. In other embodiments they can releasably attached to one another.

The adjustment member 240 preferably defines a circular ring-shaped body that has a first end 248 and a second end 250. Preferably the second end 250 lies in a single plane and is contiguous about the circumference of the ring. A plurality of first seats 252 and a plurality of second seats 254 are defined on the adjustment ring 240. Each seat 252, 254 is defined by a pair of spaced-apart walls 256 (see FIG. 7B) that extend from the first end 248 in a direction generally toward the second end 250 and terminate in a seat surface 253, 255 that extends between the spaced-apart walls and is parallel to a plane defined at the first end 248 of the ring. Each of the first seat surfaces 253 lies in a first plane, and is spaced a first distance from the first end of the ring. Each of the second seat surfaces 255 lies in a second plane and is spaced a second distance from the first end of the ring.

In the illustrated embodiment, the first seats 252 have a first wall that is normal to the first end of the adjustment member, and a second wall that is inclined relative to the first wall. A small wall, or ridge, separates the second wall of the first seat 252 from the adjacent second seat 254. In additional embodiment the walls may take various specific shapes, and adjacent seat surfaces may be separated by a bump, short wall or the like, or in some embodiments may not be separated by any wall.

The seats 252, 254 of the adjustment ring 240 are configured to receive the lugs 70 of the housing 60. As such, the seats 252, 254 are positioned and spaced so as to align with the lugs 70, and preferably there are the same number of each type of seat as there are housing lugs. In the illustrated embodiment there are three lugs 70 on the housing 60, and thus the adjustment ring 240 has three first seats 252 and three second seats 254.

Figure 7A:
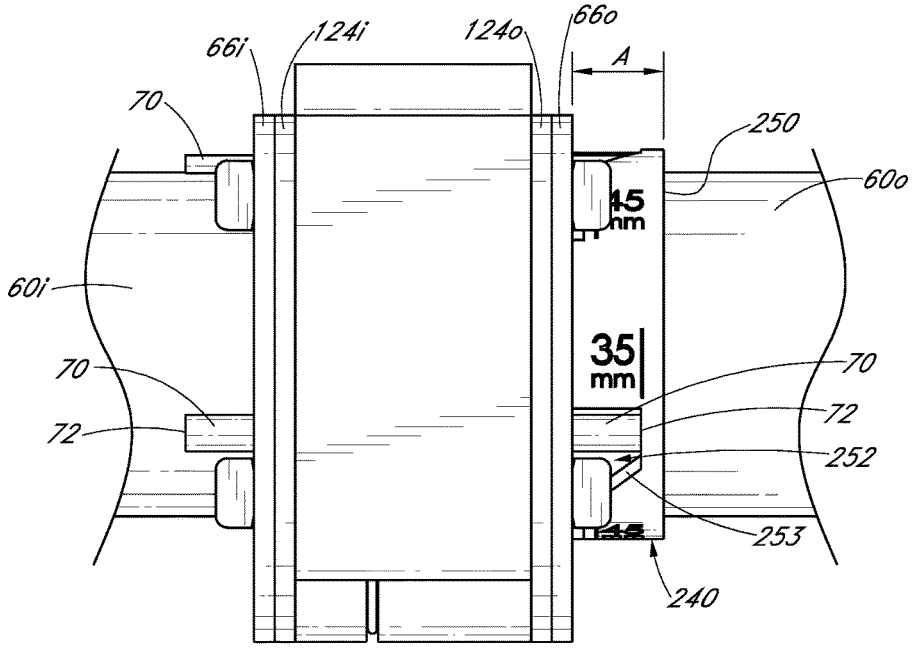
FIG. 7A is a side view of an embodiment of a lockset having an adjustment ring in a first position.

With additional reference next to FIG. 7A, preferably the adjustment ring 240 is advanced over the housing 60 so that the housing lugs 70 extend into the seats 252, 254, and the lug ends 72 engage seat surfaces 253, 255. As such, a first distance A is defined between the adjacent outside housing flange surface 66*o* and the second end 250 of the ring 240.

Figure 7B:
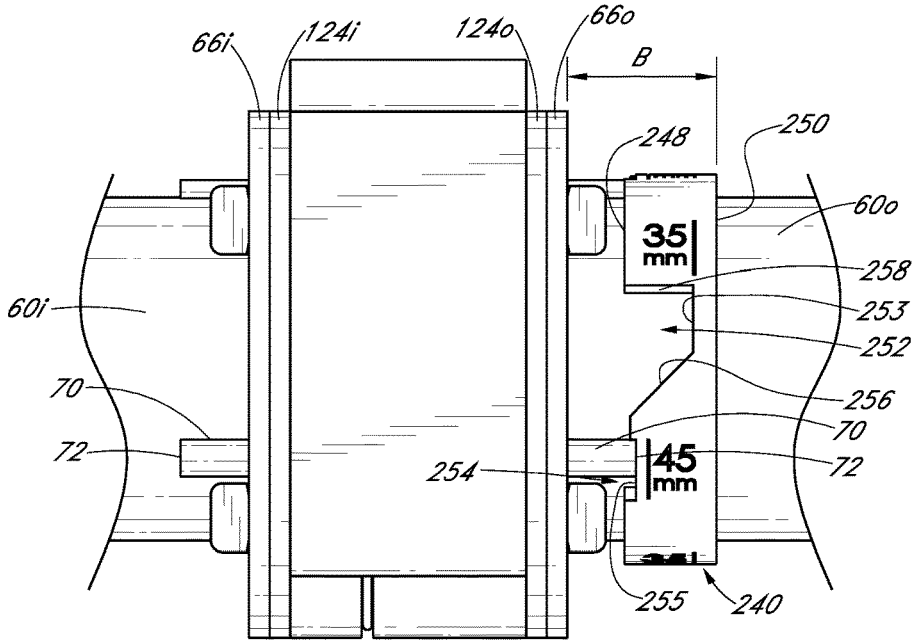
FIG. 7B is a side view of the lockset of FIG. 7A in which the adjustment ring is in a second position.

The adjustment ring 240 is movable over the housing 60 surface. With reference next to FIG. 7B, if the adjustment ring is rotated, the second seats 254 can be aligned with the lugs 70, and the adjustment ring can be advanced over the housing so that the housing lugs 70 extend into the second seats 254. In FIG. 7B, the three lug ends 72 each are engaged with the seat surfaces 255 of the second seats 254. As such, a second distance B is defined between the adjacent outside housing flange 66*o* and the second end 250 of the ring 240.

Figure 8:
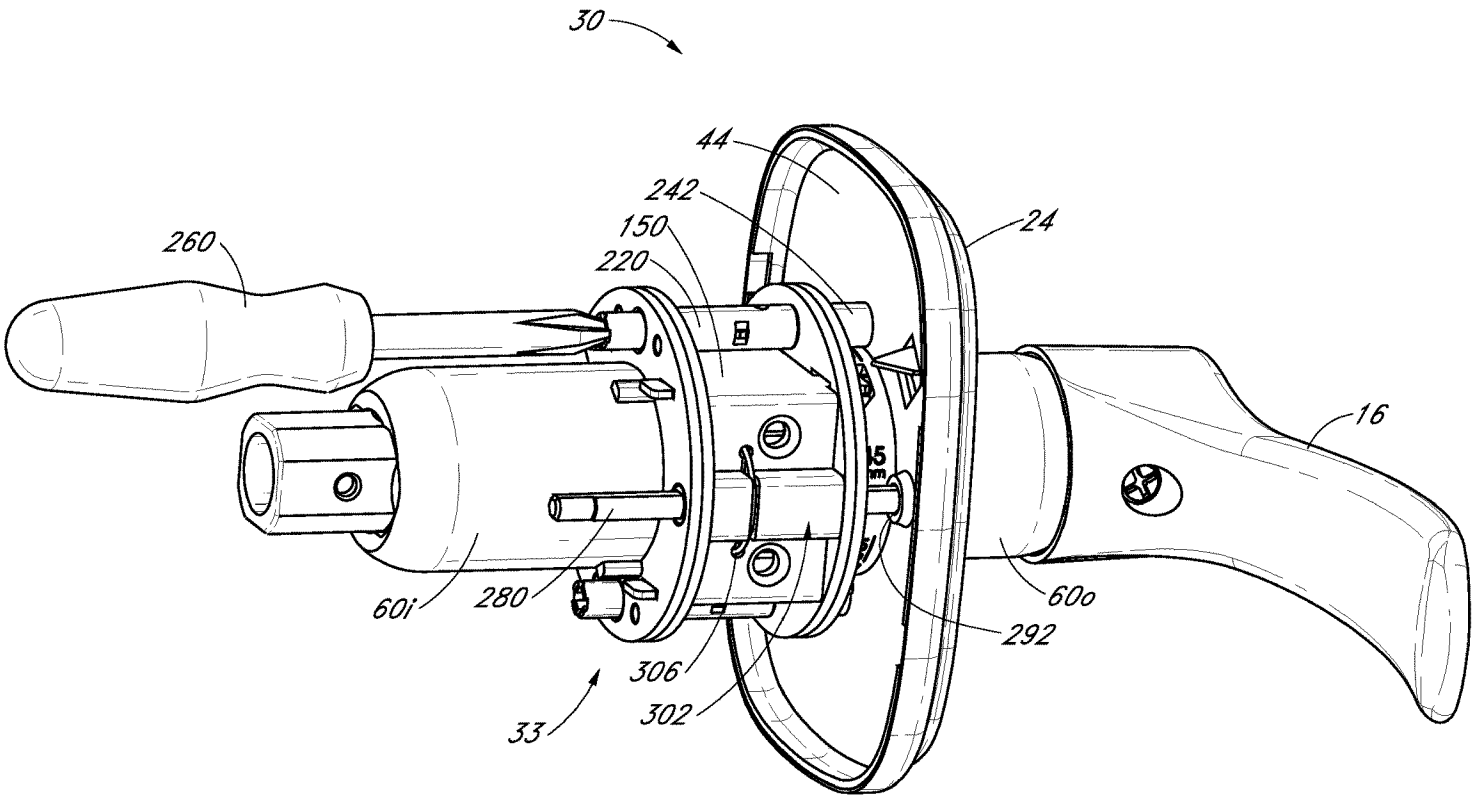
FIG. 8 shows the lockset of FIG. 6 assembled in a configuration adapted to fit a first door thickness.

With reference again to FIG. 6 and additional reference to FIGS. 8 and 13, in order to assemble the outside handle assembly 30, the male ends 222 of the cap bolts 220 are engaged with the internally-threaded mount bosses 242 of the outside mount plate 44. A driver such as a screwdriver 260 engages the female end 224 of the cap bolt 220 to threadingly engage the cap bolt 220 with the corresponding boss 242. Because the distance D is about the same as or less than distance F, the male ends 222 of the cap bolts 220 can be flush with or below the adjacent outside housing flange surface 60*o*. As such, one of the cap bolts 220 can be fully driven into the corresponding boss 242 while the other cap bolt 220 hangs loose. Both mount bosses may be near or engaged with the outside housing flange surface when one cap bolt 220 is fully driven into one of the bosses 242. However, since the other cap bolt 220 lies flush with the housing flange 66*o* surface, the surface can still be moved relative the corresponding boss 242 so as to properly align the cap bolt with the boss so that the cap bolt can then be driven into engagement.

With additional reference again to FIGS. 7A and 7B, when the cap bolts 220 engage the bosses 242, the outside mount plate 44 is pulled toward the outside housing flange 66*o* until it engages and is blocked from further longitudinal advancement by the second end 250 of the adjustment ring 240. As such, the space between the outside housing flange 66*o* and the outside mount plate 44 is defined by the space between the outside housing flange 66*o* and the second end 250 of the adjustment ring 240. For example, when the lugs 70 are engaged in the first seats 252 as in FIG. 7A, the outside mount plate 44 is spaced distance A from the outside housing flange 66*o*; when the lugs 70 are engaged in the second seats 254 as in FIG. 7B, the outside mount plate 44 is spaced distance B from the outside housing flange 66*o*.

In order to achieve optimal operation of the lockset it may be desired to mount the lockset within the door mount hole so that the latch bolt assembly engages generally a center of the retractor assembly 33. However, not all doors are the same thickness. Thus, it can be desired to adjust the lockset in view of the door thickness so that its retractor assembly is acceptably centered.

Two standard door thicknesses often used in construction are 35 mm and 45 mm. In the illustrated embodiment, the first seats 252 on the adjustment member 240 are labeled "35 mm" to indicate that engaging the lugs 70 in the first seats 252 as shown in FIG. 7A will optimize the configuration of the lockset 10 to be properly centered in a 35 mm wide door 12. Similarly, the second seats 254 are labeled "45 mm" to indicate that engaging the lugs 70 in the second seats 254 as shown in FIG. 7B will optimize the configuration of the lockset to be properly centered in a 45 mm wide door.

The first and second seats 252, 254 of the adjustment ring 240 are spaced longitudinally from one another. Since it is preferred to center the retractor assembly 33 within the door, the longitudinal distance between the first and second seat surfaces 253, 255 is preferably one half of the difference in door thickness between the doors associated with the respective seats. For example, in the illustrated embodiment the first seat 252 is associated with a 35 mm wide door and the second seat 254 is associated with a 45 mm wide door. The longitudinal distance between the first and second seat surfaces 253, 255 is 5 mm, which is 0.5×(45 mm-35 mm).

In some embodiments the outside handle assembly 30 is fully assembled before the lockset is delivered to the installer. As such, installation may be relatively easy, as discussed above in connection with FIG. 2. In the embodiment illustrated in FIG. 8, the outside handle assembly 30 is provided fully assembled and ready to be installed in a 35 mm wide door. In the illustrated configuration, the adjustment ring 240 is arranged on the housing so that the housing lugs 70 are engaged with the first seats 252 of the adjustment ring (as depicted in FIG. 7A), which corresponds to spacing desired for a 35 mm wide door. In order to optimize the position of the lockset for a 45 mm wide door, it may be desired to partially disassemble the outside handle assembly 30 and move the adjustment ring so that the housing lugs 70 are seated in the second seats 254, as depicted in FIG. 7B. and the lockset is configured to be properly centered in a 45 mm wide door.

Figure 9:
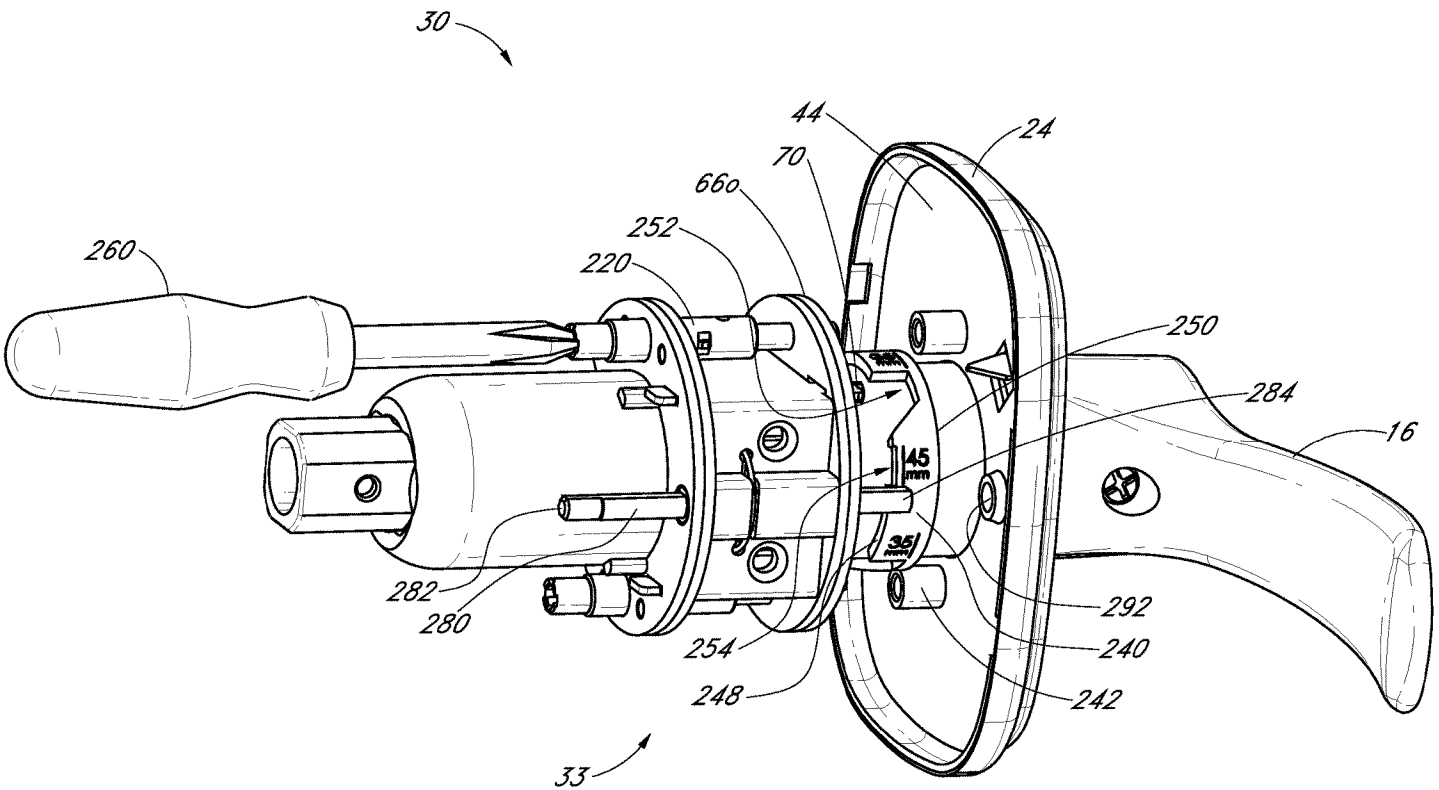
FIG. 9 shows the lockset of FIG. 6 partially disassembled.

With continued reference to FIG. 8, in order to change the thickness setting, preferably the outside handle assembly is first partially disassembled. The cap bolts 220 can be unscrewed from the outside mount plate bosses 242 and the mount plate 44 pulled away from the housing flange as depicted in FIG. 9. The adjustment ring 240 can also be pulled back from the housing flange 66*o* so as to disengage the lugs 70 from the first seats 252. Notably, in the illustrated embodiment, during this operation the outside handle 16 can be maintained in place, and the outside mount plate 44 is never fully removed from the retractor assembly 33.

Figure 10:
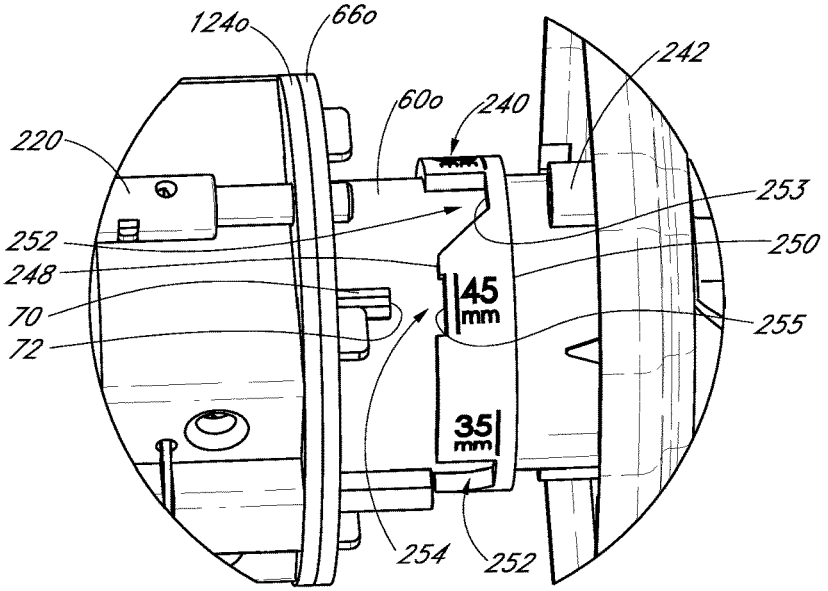
FIG. 10 is a close up view of the adjustment member and adjacent components of the lockset of FIG. 9.
Figure 11:
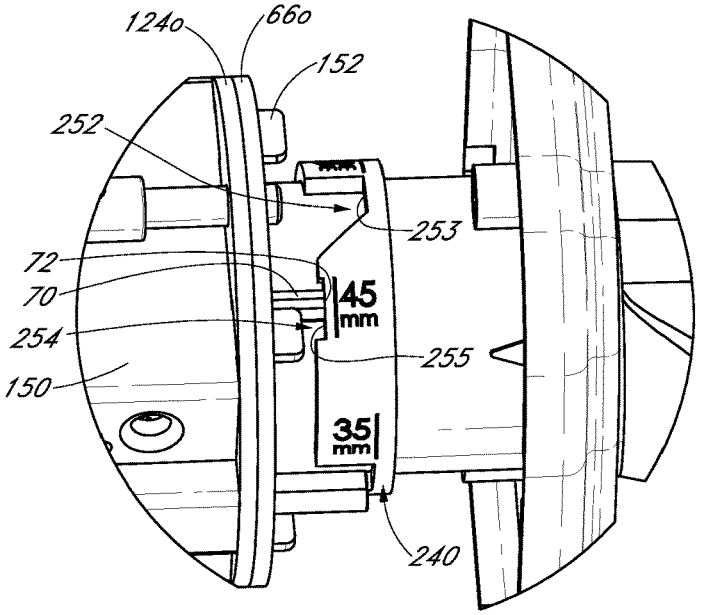
FIG. 11 shows the configuration of FIG. 10 with an adjustment member in a second position.
Figure 12:
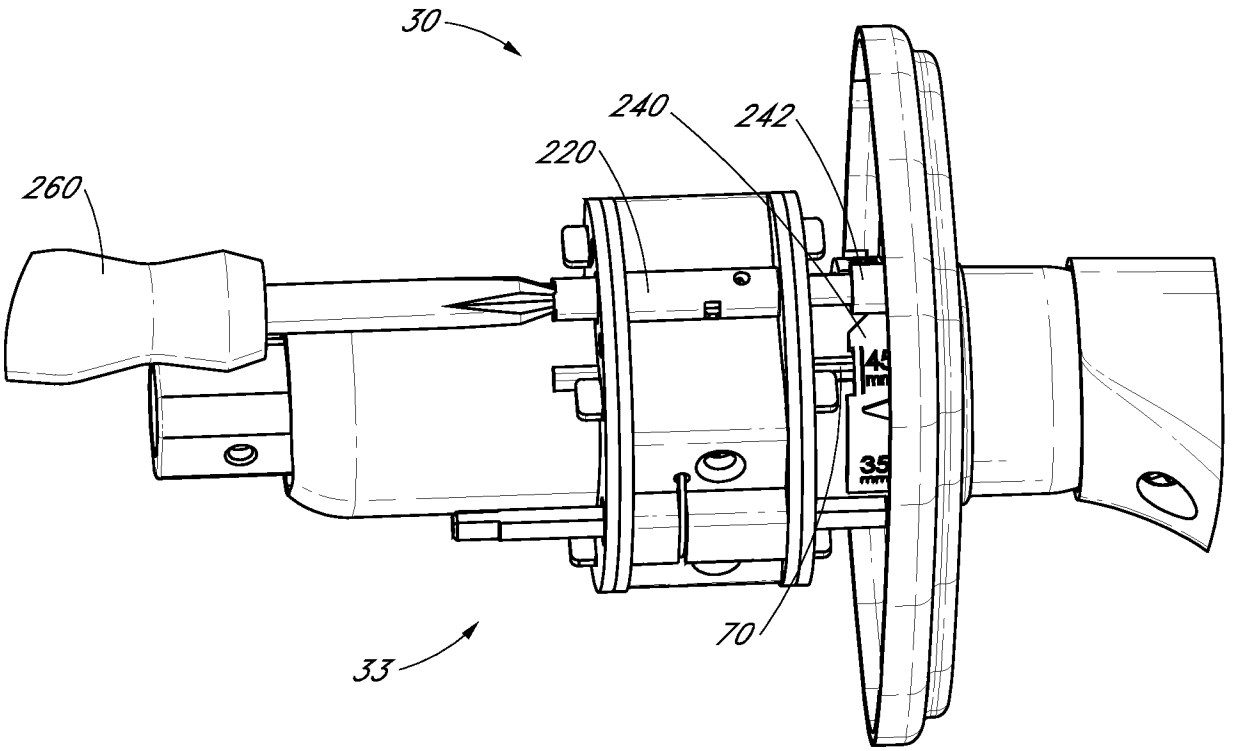
FIG. 12 shows the lockset of FIG. 6 reassembled in a configuration adapted to fit a second door thickness, and with the adjustment member arranged as in the configuration shown in FIG. 11.

With reference next to FIG. 10, the adjustment ring 240 can then be rotated so that the lugs 70 are aligned with the second seats 254. The adjustment ring 240 can then be advanced toward the housing flange so that the lug ends 72 engage the seat surfaces 255 of the second seats 254 as shown in FIG. 11. With reference next to FIG. 12, the outside mount plate 44 is then advanced and the cap bolts 220 are engaged with the bosses 242 so that the mount plate 44 engages the second end 250 of the adjustment ring 240 at a spacing (distance B as depicted in FIG. 7B) appropriate for proper centering of the lockset in a 45 mm wide door. The lockset 10 can then be installed as discussed above in connection with FIG. 2, with the mount bolts 48 engaging the threaded female ends 224 of the cap bolts 220. Notably, the position alignment of the retractor assembly 33 and other components such as the outside mount plate 44 and handle 16 are the same before and after the thickness adjustment.

With reference again to FIGS. 3 and 6, preferably, the outside housing body 62*o* outer diameter is only nominally less than an inner diameter of the adjustment ring 240 so that the adjustment ring can slide over the housing body but still fits closely. In the illustrated embodiment a circumferential slot 264 is formed in the inner surface of the adjustment member 240 adjacent its second end 250. A broken wire 266 fits partially within the slot 264. As such, when the adjustment ring 240 is fit over the housing outer surface, the wire 266 provides friction to inhibit uncontrolled sliding of the ring 240 over the housing 60 surface. Also, preferably the wire 266 is slightly smaller in diameter than the adjustment ring 240, and is deformed slightly when the ring and wire are moved onto the housing surface. In this configuration, the presence of the wire 266, which may be under tension, is a dampener that inhibits the adjustment ring 240 from vibrating, rattling or the like upon movement of the lockset. This leads to a more satisfying user experience.

In some embodiments the wire 266 is formed of a different metal than the adjustment ring 240, preferably a material chosen to optimize its friction and rattle-damping function. Also, some embodiments may employ different structures. For example, some embodiments may employ a wire that is configured in a complete ring. Some embodiments may employ more than one wire, or a coiled wire with more than one coil. Further embodiments may employ an inner ring rather than a wire, and the adjustment member may be modified to accommodate the inner ring. In still further embodiments, various materials, metal and non-metal, may be employed to provide friction and/or vibration damping for the adjustment ring. For example, one or more elastomers can be used. Further, some embodiments may dispense altogether with a friction and/or damping element.

Additional embodiments may also employ different structures for the adjustment member 240. For example, in some embodiments the adjustment member may have the form of an incomplete ring, and in some such embodiments the incomplete ring can be inwardly-biased but elastically bendable. In one such embodiment a portion of the housing may engage the outer mount plate to maintain a first space between the housing flange and mount plate, without any adjustment member installed. The incomplete ring may be elastically deformable so as to fit over the housing without completely removing the mount plate from the retractor assembly, but when released will engage the housing and can be positioned to maintain a second space between the housing flange and the mount plate, which second space is greater than the first space. In yet another embodiment, the adjustment member may comprise two or more ring-shaped members that can be moved relative to one another. When the ring-shaped members are in a first position relative to one another the adjustment member may define a first space from first end to second end; when the ring-shaped members are in a second position relative one another the adjustment member may define a second space from first end to second end.

In the illustrated embodiment, the adjustment member comprises only first and second seats 252, 254. It is to be understood that additional embodiments may have third seats, fourth seats, or more seats. Such seats preferably each define a different distance between the housing flange and the second end of the adjustment member, and thus enable more precise centering of the lockset retractor assembly within a variety of door sizes, including non-standard door sizes. Such seats may include seat surfaces that may or may not be separated from adjacent seat surfaces by a wall, ridge, bump or the like. Also, the illustrated embodiment employs three of each of the first and second seats. Some embodiments may employ only a single one of each seat. More preferably at two of each type of seat is provided, and the seats are spaced apart from one another so that a second seat is positioned between adjacent first seats.

In the illustrated embodiment, the lugs 70 are formed as part of the housing body. It is to be understood that, in other embodiments, the lugs may be part of one or more independently-formed members interposed between the flange, or some other reference point on the housing body, and the adjustment member, and that the lugs can have various shapes and specific structure.

In still other embodiments, a lockset is provided as a kit in a package having at least the retractor assembly 33 fully assembled, but other portions unassembled. In some embodiments the outside handle assembly 30 is fully assembled. In some such embodiments, an adjustment member having only first and second seats as shown in the illustrated embodiment is provided, and a second adjustment member having a different configuration, such as having third, fourth and fifth seat positions, or having a markedly different structure, is also provided. The installer thus has a choice which adjustment member to use. In some embodiments, the adjustment member having only first and second seats is included in the preassembled outside handle assembly, and one or more other types of adjustment members are provided in the kit. As such, an inexperienced installer can install the lockset and acceptably center the retractor assembly by using the provided adjustment member. However, if an experienced installer desires more precise centering, and/or if a non-standard door size is encountered, the pre-installed adjustment member may be removed, and one or more of the other adjustment members may be employed. It is also to be understood that, in such other embodiments, various configurations of adjustment members, including an adjustment member system comprising a set of several rings each having a different thickness, can be provided for such enhanced or optional installation.

With reference next to FIGS. 3 and 14-17, a locking member 270 is provided to enable a user to selectively lock the lockset 10. As will be discussed in more detail below, the illustrated locking member 270 enables a user to engage a lock to prevent the outside handle 16 from actuating the lockset, and will enable a user to disengage the lock by actuating the inside handle 14.

The locking member 270 comprises an elongate lock actuator bar 280 having an inside end 282 and an outside end 284. In the illustrated embodiment the cap flanges 124 and housing flanges 66 each have a lock member hole 290 configured to accommodate the lock actuator bar 280, as best shown in FIG. 3. The outside mount plate 44 and rose 24 also have a lock member access hole 292 to accommodate and/or provide access to the lock actuator bar 280, as shown in FIGS. 4, 5, 8-9 and 16-17. The inside end 282 of the lock actuator bar 280 is threaded, and accommodates an internally threaded lock button 300 (as in, for example, FIGS. 14 and 16) that can extend at least partially through button holes 296 in the inside rose 20 and inside mount plate 46 (see FIG. 2). Thus, a user on the inside of the door can push or pull the lock button 300 to urge the lock actuator bar 280 longitudinally.

Continuing with reference to FIG. 3 and FIGS. 15-17, the casing 150 includes a channel 302 formed in its surface opposite the casing opening 158. The channel 302 is configured to accommodate the lock bar actuator 280 extending therethrough. With additional reference to FIGS. 8 and 14-17, a slot 304 is formed through the casing 150 transversely across the channel 302. A wire spring 306 preferably is arranged at and adjacent the slot 304. Opposing ends of the wire spring 306 extend through the slot 304 on opposing sides of the channel 302 and engage the casing 150 so as to bias the rest of the wire spring 306 through the slot 304 and into contact with the lock bar actuator 280 within the channel 302.

Continuing with reference to FIGS. 3 and 14-17, the lock actuator bar 280 includes detent notches sized to accept the wire spring 306. The detent notches include a locked detent notch 310 and an unlocked detent notch 312. When the wire spring 306 is engaged with either the locked detent notch 310 or the unlocked detent notch 312, a detent effect operates to maintain the lock actuator bar 280 in that longitudinal position unless a significant longitudinal force is applied to the lock actuator bar to overcome the spring force.

A control arm 320 extends outwardly from the lock actuator bar 280. Preferably the control arm 320 is rigidly attached to the lock actuator bar 280 so as to move with the actuator. The control arm 320 comprises a flat body 322 that extends outwardly normal to the lock actuator bar 280, a lock portion 324 that extends from the flat body 322 in a direction towards the outside handle 16, and a wedge-shaped control portion 326 adjacent the lock bar actuator 280. The wedge-shaped control portion 326 extends from the flat body 322 in a direction toward the outside handle 16 and has a control edge 330. The control portion 326 tapers from a point adjacent the lock bar actuator 280 to a point at which the control edge 330 intersects with the flat body 322. As such, the control edge 330 appears inclined relative to the lock actuator bar 280.

The flat body 322 has a recessed portion 332 extending from the point at which the control edge 330 intersects the flat body to an end of the flat body. As such, the flat body 322 adjacent the recessed portion 332 is offset to one side of a plane taken through the lockset axis and normal to the flat body.

With particular reference again to FIGS. 14-17, the retractor 40 has an inside edge 336 and an outside edge 338. In the illustrated embodiment the entire outside edge 338 of the retractor 40 lies in a single plane. However, a recessed portion 340 of the inside edge 336 lies in a plane offset from the rest of the inside edge 336. The recessed portion 340 is formed at the second end 170 of the retractor 40.

In the illustrated embodiment, the spring bosses 168 at the second end 170 of the retractor 40 are centered between the recessed portion 340 of the inside edge 336 and the outside edge 338. The spring bosses in the casing 150 are positioned to align with the retractor spring bosses 168. As such, the spring bosses 180 in the casing 150 are closer to an outside edge of the casing 150 than to an inside edge of the casing.

Figure 15:
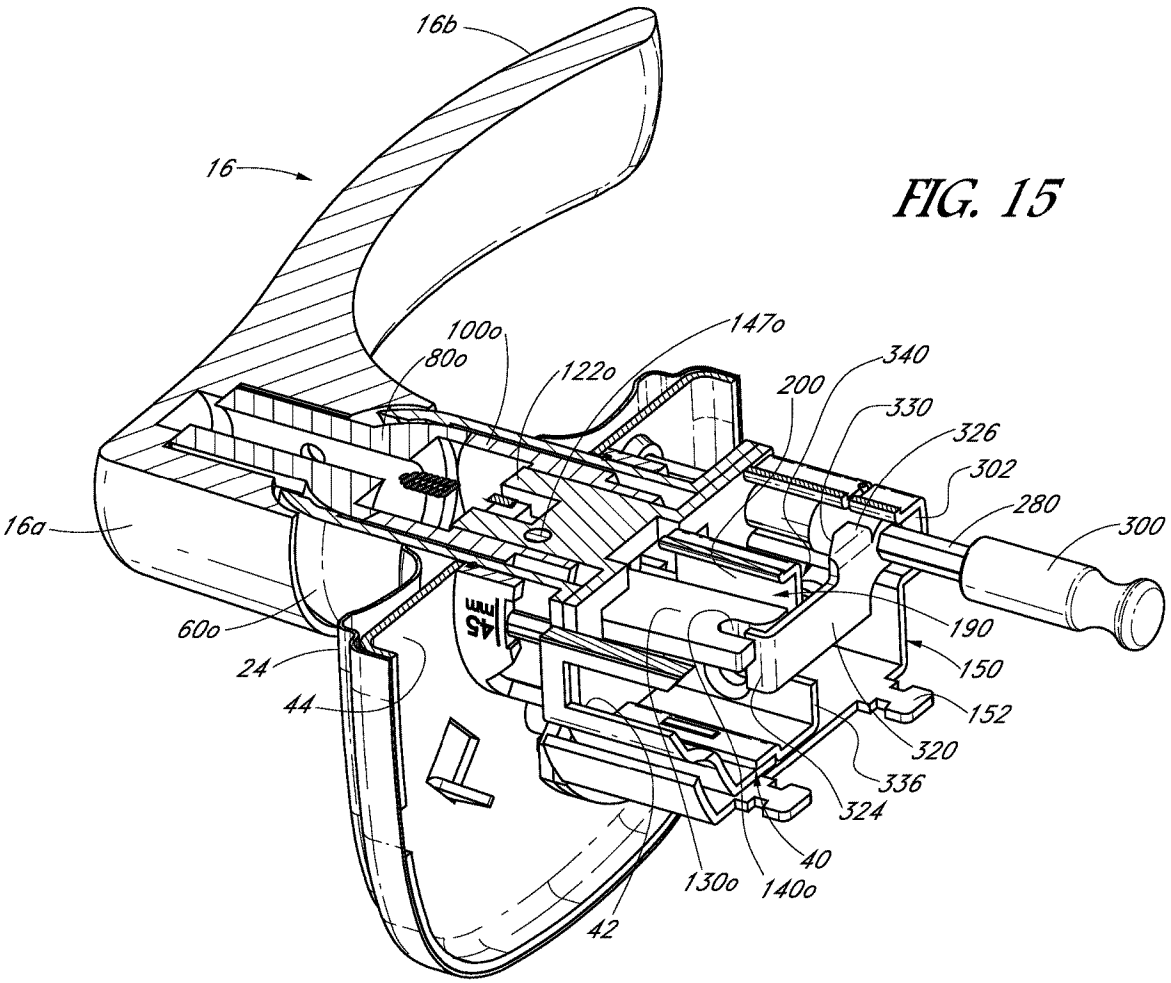
FIG. 15 is a partial cross-sectional perspective view of the lockset of FIG. 1A in which a privacy lock is shown in an engaged position, and several components associated with actuating the retractor assembly via an inside handle have been removed for clarity.
Figures 16, 16A:
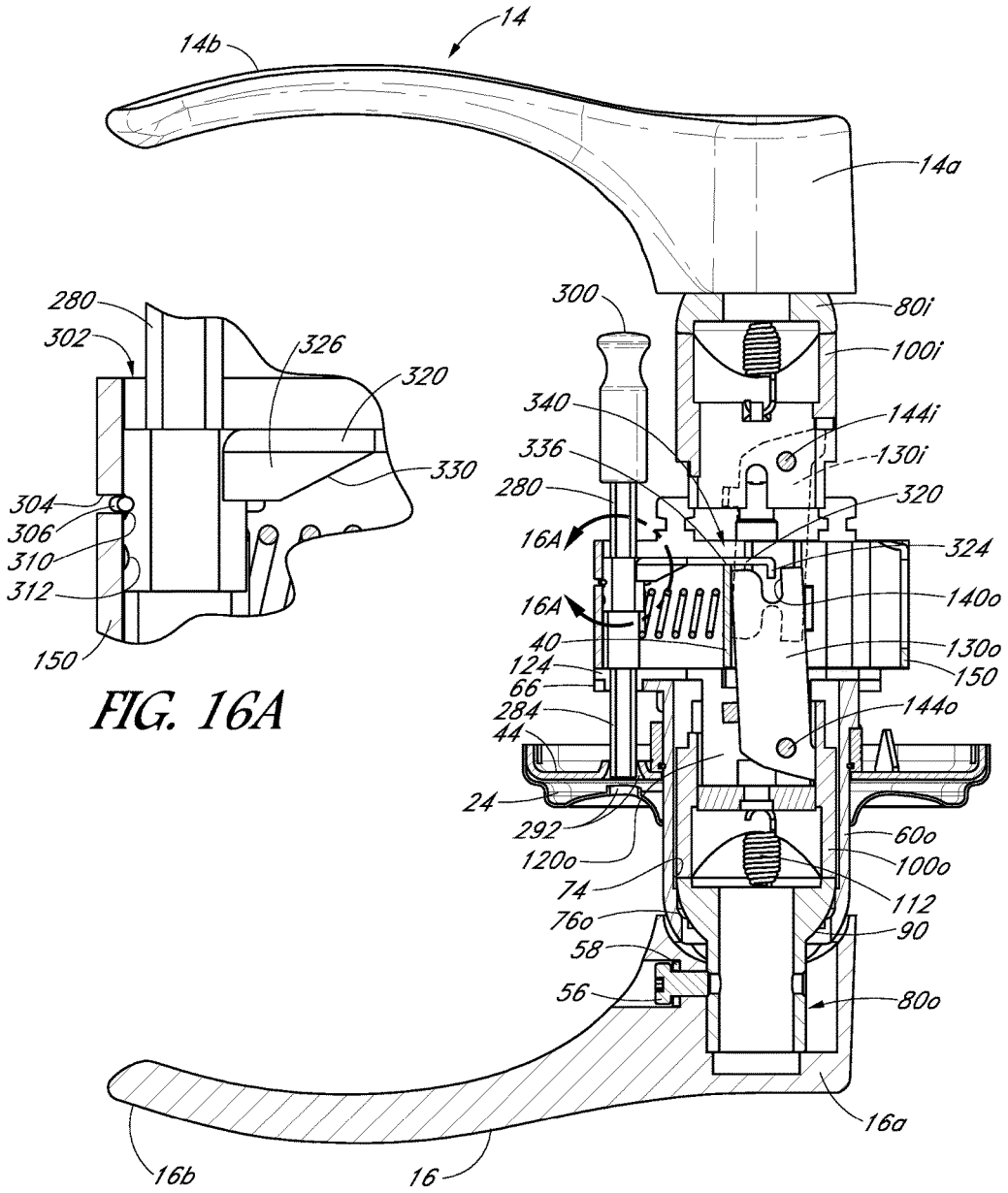
FIG. 16 is a view similar to that of FIG. 4, but showing a privacy lock in an engaged position and the inside retractor arm in ghost lines.
FIG. 16A is a close up view taken along line 16A-16A of FIG. 16.
Figures 17, 17A:
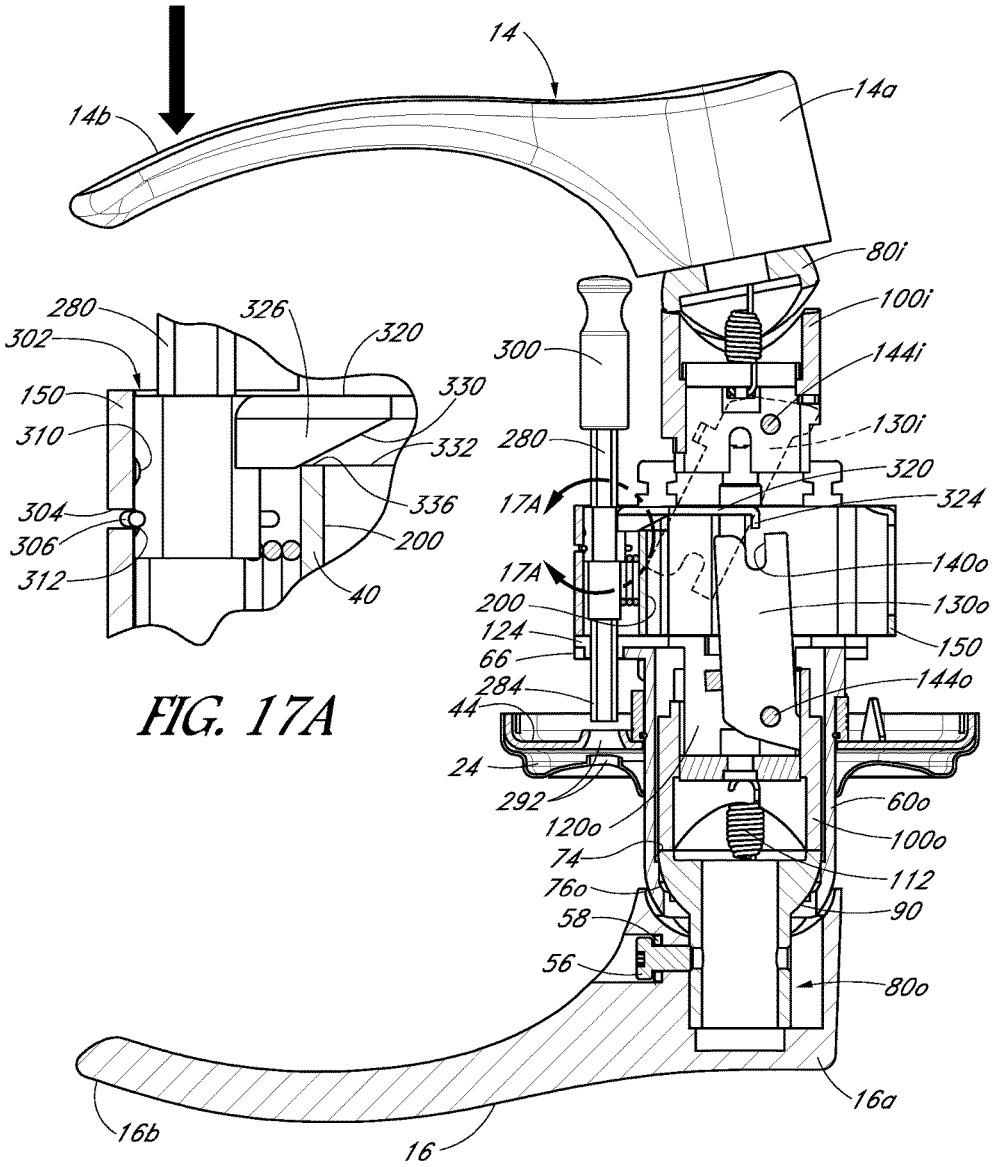
FIG. 17 is a view similar to that of FIG. 4, but showing a privacy lock in a disengaged position and the inside retractor arm in ghost lines.
FIG. 17A is a close up view taken along line 17A-17A of FIG. 17.

In FIG. 17, the inside retractor arm **130*i* is depicted in dotted lines so as to better illustrate the components behind the inside retractor arm in that view. As shown, the control arm 320 is sized so that the lock portion 324 is aligned with the outside retractor arm lock receiver slot 140. When a user depresses the lock button 300 the locking member 270 moves longitudinally to a locked position in which the wire 306 is engaged in the locked detent notch 310, the flat body 322 of the control arm 320 is pushed into the recessed portion 340 of the retractor 40 adjacent the retractor inside edge 336, and the lock portion 324 extends into the outside retractor arm lock receiver slot 140*o* as shown in FIGS. 15 and 16. In this position, the lock portion 324 prevents the outside retractor arm 130*o* from rotating. Thus, any attempt to actuate the outside handle 16*o* to retract the latch bolt 28** will be unsuccessful.

The control arm 320, however, does not interfere with operation of the inside retractor arm **130*i*. More specifically, just as the inside and outside retractor arms are disposed on opposite sides of the lockset axis, the control arm 320 extends only on the side of the lockset axis corresponding to the outside retractor arm 130*o*. Thus, when the outside retractor arm 130*o* is blocked from rotating by the lock portion 324, the inside retractor arm 130*i*** remains free to rotate.

With reference next to FIGS. 17 and 17A, actuation of the inside handle 14 when the lock 324 is engaged results in the same operation as described above in connection with FIGS. 4 and 5. Namely, the inside retractor arm **130*i* is rotated, thus urging the retractor 40 in a direction transverse to the lockset axis and opening the latch bolt 28. Also, as the retractor 40 moves, its inside edge 336 in the recessed portion 340 eventually engages the control edge 330 of the wedge-shaped portion 326 of the control arm 320. Upon continued movement of the retractor 40, the inside edge 336 exerts a force on the inclined control edge 330. The force disengages the wire 306 from the locked detent notch 310, and the actuator bar 280 moves longitudinally toward the inside handle 14 as the retractor 40 continues its stroke. At the end of the retractor stroke, as shown in FIGS. 17 and 17A, the lock actuator bar 280 has moved longitudinally sufficient so that the lock portion 324 is disengaged from the outside retractor arm lock receiver slot 140*o* and the locking member 270 is in the unlocked position in which the wire 306 is engaged in the unlocked detent notch 312**.

In the illustrated embodiment, the wedge-shaped portion 326 of the control arm 320, and specifically the control edge 330, lies in a plane offset from the lockset axis, and most preferably aligned with the rotational plane in which the inside retractor arm **130*i* rotates. As such, the control edge 330 is aligned with the insider retractor arm 130*i*, and force applied by the first retractor arm to the retractor 40 is aligned with the control edge 330. Also, in the illustrated embodiment, the recessed portion 332 of the control arm 320 has a generally flat edge. Further, the control edge plane is offset from an axis of the actuator bar 280. As such, if force communicated by the first retractor arm to the control edge 330 would tend to impart rotation to the actuator bar 280, the flat edge of the recessed portion 332 can engage the flat inside retractor arm to offset such force while still enabling the inside retractor arm to slidably rotate. Of course, it is to be understood that, in other embodiment, the control edge 330** can be aligned with the lockset axis or be positioned in other configurations.

In the illustrated embodiment the locking member 270 is configured as a privacy lock that can be defeated from the outside by, for example, advancing a tool or key having an elongate portion through the lock actuator bar holes 292 in the outside rose 24/mount plate 44 so as to manually push the locking member 280 from the locked position to the unlocked position. Pulling on the pin 300 from inside will also move the locking member 280 from the locked position to the unlocked position. It is to be understood that the principles and structure described herein can be used in other configurations. For example, in another embodiment, a keyed lock cylinder is accessible through the outside rose 24. The keyed lock cylinder can be spaced from the locking member 280. Upon turning of an authorized key in the lock cylinder, a wedge-shaped actuator or the like is pushed across the outside end 284 of the lock actuator bar 280, thus pushing the locking member to the unlocked position. Similarly, a wedge-shaped actuator can engage a cam on or attached to the lock actuator bar to pull the locking member to the locked position when the key is turned in a locking direction.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A method of installing a lockset, comprising:

determining whether a door has a first width or a second width;

moving an adjustment member relative to a retractor assembly housing so that the adjustment member is in a first position relative to the retractor assembly housing in which a first seat of the adjustment member is engaged with an engagement surface of the retractor assembly housing if the door has the first width and the adjustment member is in a second position relative to the retractor assembly housing in which a second seat of the adjustment member is engaged with the engagement surface of the retractor assembly housing if the door has the second width, wherein a distance between a reference point on the engagement surface of the retractor assembly housing and a blocking side of the adjustment member is a first distance when the adjustment member is in the first position and a second distance when the adjustment member is in the second position, moving the adjustment member comprising sliding the adjustment member longitudinally and rotatably over the retractor assembly housing;

advancing a first mount plate over the retractor assembly housing so that the first mount plate abuts the blocking side of the adjustment member, a wall disposed between the first seat and the second seat blocking movement of the adjustment member from the first position to the second position when the first mount plate abuts the blocking side;

advancing the retractor assembly housing through a door mount hole so that the first mount plate engages a first door surface at and adjacent the door mount hole;

advancing a second mount plate over the retractor assembly housing so that the second mount plate engages a second door surface opposite the first door surface; and connecting the first mount plate and second mount plate so that the retractor assembly housing is supported within the door mount hole.

2. A method as in claim 1, wherein a retractor assembly attached to the retractor assembly housing is supported generally centered within the door mount hole.

3. A method as in claim 2, wherein the first seat and the second seat are at discrete positions separated by the wall, and the difference between the first distance and the second distance is half the difference between the first width and the second width.

4. A method as in claim 3, wherein the adjustment member is ring-shaped and has a plurality of first seats and a plurality of second seats, each first seat lying in a first seat plane, each second seat lying in a second seat plane, and the blocking side lying in a blocking side plane, the first seat plane, second seat plane and blocking side plane being parallel to one another.

5. A method as in claim 4, wherein the retractor assembly housing comprises a plurality of lugs, and moving the adjustment member so that the adjustment member is in the first position comprises moving the adjustment member rotatably so that the plurality of lugs are aligned with the plurality of first seats and moving the adjustment member longitudinally so that the plurality of lugs are engaged by the plurality of first seats, the engagement surface being defined on one of the plurality of lugs.

6. A method as in claim 5, wherein each of the plurality of lugs comprises a lug engagement surface, and each of the lug engagement surfaces lies in a lug engagement plane, each first seat engaging a corresponding one of the lug engagement surfaces.

7. A method as in claim 6, wherein the retractor assembly housing has a longitudinal axis, and each of the plurality of lugs is elongated in a longitudinal direction.

8. A method as in claim 1, wherein the first mount plate is secured to the retractor assembly housing and abutting the blocking side of the adjustment member, and the adjustment member is in the first position, and wherein if it is determined that the door has the second width, the step of moving the adjustment member comprises releasing the first mount plate from the retractor assembly housing, moving the first mount plate out of contact with the adjustment member, and moving the adjustment member over the retractor assembly housing from the first position to the second position.

9. A method as in claim 8, wherein connecting the first mount plate and the second mount plate comprises securing the second mount plate to the retractor assembly housing and securing the first mount plate to the retractor assembly housing.

10. A method as in claim 9, wherein securing the first mount plate to the retractor assembly housing comprises threading a male end of a first cap bolt with a first boss of the first mount plate so that a first stop of the first cap bolt engages a first flange of the retractor assembly housing.

11. A method as in claim 10, wherein when threading the first cap bolt with the first boss, a second cap bolt is supported by the first flange and a second flange of the retractor assembly housing so that a second stop of the second cap bolt engages the second flange of the retractor assembly housing and a male end of the second cap bolt is positioned within a hole of the first flange.

12. A method as in claim 8, wherein moving the adjustment member from the first position to the second position comprises sliding the adjustment member longitudinally over the retractor assembly housing to disengage the first seat from the engagement surface, rotating the adjustment member to align the second seat with the engagement surface, and sliding the adjustment member longitudinally over the retractor assembly housing to engage the second seat with the engagement surface.

13. A method as in claim 1, wherein the adjustment member is generally ring-shaped, and additionally comprising allowing a damping member disposed between the adjustment member and the retractor assembly housing to inhibit the adjustment member from sliding over the retractor assembly housing before advancing the first mount plate to abut the blocking side of the adjustment member.

* * * * *